US010108110B2

(12) United States Patent
Hori et al.

(10) Patent No.: US 10,108,110 B2
(45) Date of Patent: Oct. 23, 2018

(54) DEVELOPING DEVICE

(71) Applicant: CANON KABUSHIKI KAISHA, Tokyo (JP)

(72) Inventors: Takuya Hori, Kashiwa (JP); Dai Kanai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 15/616,733

(22) Filed: Jun. 7, 2017

(65) Prior Publication Data

US 2017/0357186 A1 Dec. 14, 2017

(30) Foreign Application Priority Data

Jun. 9, 2016 (JP) ..... 2016-115521

(51) Int. Cl.
*G03G 15/08* (2006.01)
*G03G 15/09* (2006.01)

(52) U.S. Cl.
CPC ..... *G03G 15/0891* (2013.01); *G03G 15/0921* (2013.01)

(58) Field of Classification Search
CPC ..... G03G 15/0891; G03G 15/0921
USPC ..... 399/258
See application file for complete search history.

(56) References Cited

U.S. PATENT DOCUMENTS

2014/0086638 A1* 3/2014 Sato ..... G03G 15/0891 399/252
2015/0125186 A1* 5/2015 Hirobe ..... G03G 15/0893 399/269

FOREIGN PATENT DOCUMENTS

JP 2011028216 A 2/2011

* cited by examiner

*Primary Examiner* — Billy Lactaoen
(74) *Attorney, Agent, or Firm* — Canon U.S.A., Inc. IP Division

(57) ABSTRACT

An opposing surface of a partition opposing a first conveyance screw includes an arc-shaped guide portion for guiding conveyance of developer at least on an upstream side in a first conveyance direction of the first conveyance screw. The guide portion is extended from a bottom portion of a first chamber opposing the first conveyance screw and formed along an outer periphery of the first conveyance screw. As seen in a cross section orthogonal to a rotation axis of the first conveyance screw, the opposing surface of the partition within a predetermined area includes the guide portion over an angle of 30% or more of the predetermined area in a direction of rotation of the first conveyance screw.

9 Claims, 17 Drawing Sheets

F-F SECTIONAL VIEW

DEVELOPING DEVICE

BACKGROUND OF THE INVENTION

Field of the Invention

The disclosure relates to a developing device.

Description of the Related Art

A developing device discussed in Japanese Patent Application Laid-Open No. 2011-28216 is a function-separated developing device which includes a function of supplying a developer to a developer bearing member separately from a function of collecting the developer from the developer bearing member.

The function-separated developing device includes a first chamber, a second chamber, and a partition for separating the first and second chambers. In the first chamber, the developer is supplied to the developer bearing member. In the second chamber, the developer passing through a developing area opposed to an image bearing member is collected from the developer bearing member. The function-separated developing device further includes a collecting guide portion for guiding to collect the developer passing through the developing area and stripped off a surface of the developer bearing member by a magnetic field generated by a magnet unit into the second chamber. The collecting guide portion is arranged on the partition.

The function-separated developing device conveys the developer from an upstream side to a downstream side in a developer conveyance direction of a first conveyance screw arranged in the first chamber. The developer in the first chamber is supplied to the developer bearing member. Accordingly, a height of the developer surface in the first chamber tends to be high on the upstream side in the developer conveyance direction of the first conveyance screw, compared to the downstream side. The function-separated developing device also conveys the developer from an upstream side to a downstream side in a developer conveyance direction of a second conveyance screw arranged in the second chamber. The developer is collected from the developer bearing member. As a result, a height of the developer surface in the second chamber tends to be high on the downstream side in the developer conveyance direction of the second conveyance screw, compared to the upstream side.

In the function-separated developing device, the height of the developer surface in the first chamber tends to be higher than that of the first conveyance screw on the upstream side in the developer conveyance direction of the first conveyance screw. This increases the amount of developer that does not receive the conveyance force in the developer conveyance direction by the first conveyance screw. In the function-separated developing device, if the amount of developer remaining on the upstream side in the developer conveyance direction of the first conveyance screw increases, the height of the developer surface on the downstream side in the developer conveyance direction of the first conveyance screw decreases significantly. Therefore, a function-separated developing device that can suppress a decrease in the height of the developer surface on the downstream side in the developer conveyance direction of the first conveyance screw with the limited amount of developer without increasing the amount of developer itself filled into the developing container is demanded.

The developing device discussed in Japanese Patent Application Laid-Open No. 2011-28216 is then configured so that a blade portion of the first conveyance screw has a smaller outer diameter on the downstream side in the developer conveyance direction of the first conveyance screw than that on the upstream side in the developer conveyance direction of the first conveyance screw. However, if the configuration discussed in Japanese Patent Application Laid-Open No. 2011-28216 is employed, the reduced diameter of the blade portion of the first conveyance screw on the downstream side in the developer conveyance direction of the first conveyance screw can affect the capability of conveying the developer.

For this reason, a new configuration of a function-separated developer apparatus for guiding conveyance of the developer and reducing the developer remaining on the upstream side in the developer conveyance direction of the first conveyance screw is demanded.

SUMMARY OF THE INVENTION

The disclosure is directed to a function-separated developing device including a configuration for guiding conveyance of the developer and reducing the developer remaining on the upstream side in the developer conveyance direction of the first conveyance screw.

According to an aspect of the disclosure, a developing device includes a developer bearing member rotatably arranged and configured to bear developer including toner and carrier to convey the developer to a developing area opposing an image bearing member, a first chamber arranged below a rotation center of the developer bearing member in a direction of gravity and configured to supply the developer to the developer bearing member, a second chamber opposing the developer bearing member and configured to collect the developer passing through the developing area from the developer bearing member, a partition configured to separate the first chamber and the second chamber, the partition including a collecting guide portion for guiding the developer that has passed through the developing area from the developer bearing member to the second chamber for collection, a first conveyance screw rotatably arranged in the first chamber and configured to convey the developer in the first chamber in a first conveyance direction, and a second conveyance screw rotatably arranged in the second chamber and configured to convey the developer in the second chamber in a second conveyance direction opposite to the first conveyance direction, wherein an opposing surface of the partition opposing the first conveyance screw includes an arc-shaped guide portion for guiding conveyance of the developer at least on an upstream side in the first conveyance direction of the first conveyance screw, the guide portion being extended from a bottom portion of the first chamber opposing the first conveyance screw and formed along an outer periphery of the first conveyance screw, and wherein as seen in a cross section orthogonal to a rotation axis of the first conveyance screw, the opposing surface of the partition within a predetermined area includes the guide portion formed by an angle of 30% or more of the predetermined area in a direction of rotation of the first conveyance screw, the predetermined area lying above a rotation center of the first conveyance screw and being sandwiched between a line segment connecting the rotation center of the first conveyance screw and a rotation center of the second conveyance screw and a line segment connecting the rotation center of the first conveyance screw and the rotation center of the developer bearing member, the predetermined area being an area on which side the collecting guide portion is located.

Further aspects and features of the disclosure will become apparent from the following description of various example embodiments with reference to the attached drawings.

DESCRIPTION OF THE EMBODIMENTS

Various example embodiments of the disclosure will be described in detail below with reference to the accompanying drawings. The following example embodiments are not intended to limit the disclosure according to the claims, and all combinations of features described in the example embodiments are not necessarily indispensable to the solving means of the disclosure. An example embodiment of the disclosure may be applied to various applications, including a printer, various types of printing machines, a copying machine, a facsimile (FAX) machine, and a multifunction peripheral.

<Example Configuration of Image Forming Apparatus>

First, a configuration of an image forming apparatus according to a first example embodiment will be described with reference to the sectional view of FIG. 1.

Figure 1:
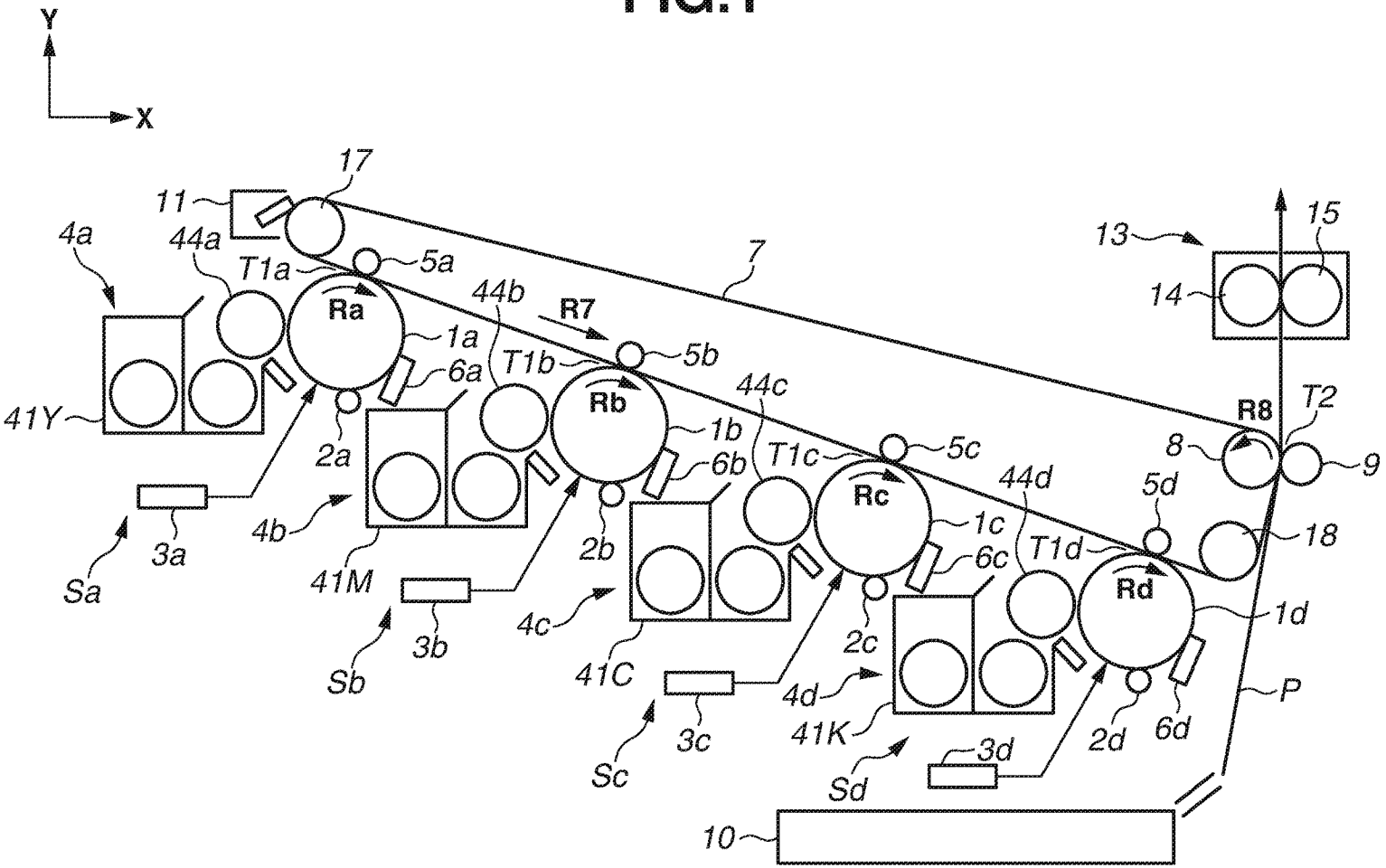
FIG. 1 is a sectional view illustrating an example configuration of an image forming apparatus.

As illustrated in FIG. 1, the image forming apparatus includes an endless intermediate transfer belt 7 serving as an intermediate transfer member, and four image forming units S (Sa, Sb, Sc, and Sd) from an upstream side to a downstream side in a direction of rotation of the intermediate transfer belt 7 (the direction of the arrow R7).

The image forming units S (Sa, Sb, Sc, and Sd) form yellow (Y), magenta (M), cyan (C), and black (Bk) color toner images, respectively.

The image forming, units S (Sa, Sb, Sc, and Sd) include rotatable photosensitive drums 1 (1*a*, 1*b*, 1*c*, and 1*d*) serving as image bearing members.

The photosensitive drums 1 (1*a*, 1*b*, 1*c*, and 1*d*) are driven to rotate in the directions of the respective arrows R (Ra, Rb, Rc, and Rd) (i.e., clockwise). Charging rollers 2 (2*a*, 2*b*, 2*c*, and 2*d*) serving as charging units are arranged around the photosensitive drums 1 (1*a*, 1*b*, 1*c*, and 1*d*) along the directions of rotation of the photosensitive drums 1 (1*a*, 1*b*, 1*c*, and 1*d*). Exposure devices 3 (3*a*, 3*b*, 3*c*, and 3*d*) serving as latent image forming units are arranged around the photosensitive drums 1 (1*a*, 1*b*, 1*c*, and 1*d*) along the directions of rotation of the photosensitive drums 1 (1*a*, 1*b*, 1*c*, and 1*d*).

Developing devices 4 (4*a*, 4*b*, 4*c*, and 4*d*) serving as developing units and primary transfer rollers 5 (5*a*, 5*b*, 5*c*, and 5*d*) serving as primary transfer units are further arranged around the photosensitive drums (1*a*, 1*b*, 1*c*, and 1*d*). Photosensitive drum cleaning blades 6 (6*a*, 6*b*, 6*c*, and 6*d*) serving as photosensitive drum cleaners are also arranged around the photosensitive drums 1 (1*a*, 1*b*, 1*c*, and 1*d*).

The developing devices 4 each are detachable from and attachable to the image forming apparatus. The developing devices 4 (4*a*, 4*b*, 4*c*, and 4*d*) include respective developing containers 41 (41Y, 41M, 41C, and 41K) each containing a two-component developer (hereinbelow, referred to simply as a developer) including toner and a magnetic carrier.

The intermediate transfer belt 7 is stretched around the primary transfer rollers 5 (5*a*, 5*b*, 5*c*, and 5*d*), a secondary transfer counter roller 8, a tension roller 17, and a tension roller 18. The secondary transfer counter roller 8 also serves as a drive roller.

The intermediate transfer belt 7 is pressed by the primary transfer rollers 5 (5*a*, 5*b*, 5*c*, and 5*d*) from a back side of the intermediate transfer belt 7.

The surface of the intermediate transfer belt 7 is in contact with the photosensitive drums 1 (1*a*, 1*b*, 1*c*, and 1*d*). Primary transfer nip portions T1 (T1*a*, T1*b*, T1*c*, and T1*d*) serving as primary transfer units are thereby formed between the photosensitive drums 1 (1*a*, 1*b*, 1*c*, and 1*d*) and the intermediate transfer belt 7.

As the secondary transfer counter roller 8 rotates the direction of the arrow R8 (counterclockwise), the intermediate transfer belt 7 rotates in the direction of the arrow R7. A rotation speed of the intermediate transfer belt 7 is set to be substantially the same as the rotation speed (process speed) of each of the photosensitive drums 1 (1*a*, 1*b*, 1*c*, and 1*d*).

A secondary transfer roller 9 serving as a secondary transfer unit is arranged on the surface of the intermediate transfer belt 7 at a position corresponding to the secondary transfer counter roller 8. The intermediate transfer belt 7 is sandwiched between the secondary transfer counter roller 8 and the secondary transfer roller 9. With this configuration, a secondary transfer nip portion T2 serving as a secondary transfer unit is formed between the secondary transfer roller 9 and the intermediate transfer belt 7.

A belt cleaner 11 serving as an intermediate transfer member cleaner is in contact with the surface of the intermediate transfer belt 7 at a position corresponding to the tension roller 17.

Sheets P (e.g., paper sheets or transparent sheets) for use in image formation by the image forming units S (Sa, Sb, Sc, and Sd) are stacked and stored in a feed cassette 10 serving as a sheet storage unit. A sheet P is supplied to the secondary transfer nip portion T2 by a feed and conveyance device including a feed roller, a conveyance roller, and a registration roller. A fixing device 13 including a fixing roller 14 and a pressure roller 15 is arranged downstream of the secondary transfer nip portion T2 in a conveyance direction of the sheet P. A discharge tray for stacking sheets P discharged out of the image forming apparatus is arranged downstream of the fixing device 13 in the conveyance direction of the sheet P.

<Configuration of Image Forming Units>

The photosensitive drums 1 (1*a*, 1*b*, 1*c*, and 1*d*) are cylindrical (drum-shaped) electrophotographic photosensitive members each including a photosensitive layer made of an organic optical semiconductor having a negative charging characteristic. For example, the photosensitive drums 1 (1*a*, 1*b*, 1*c*, and 1*d*) have a diameter of 30 mm, a longitudinal length of 360 mm, and a process speed (circumferential speed) of 250 mm/sec. During image formation, the photosensitive drums 1 (1*a*, 1*b*, 1*c*, and 1*d*) are driven to rotate in a forward direction (directions of the arrows R (Ra, Rb, Rc, and Rd) by a motor.

The charging rollers 2 (2*a*, 2*b*, 2*c*, and 2*d*) are in contact with the photosensitive drums 1 (1*a*, 1*b*, 1*c*, and 1*d*) and biased toward the photosensitive drums 1 (1*a*, 1*b*, 1*c*, and 1*d*) by pressure springs. During image formation, the charging rollers 2 (2*a*, 2*b*, 2*c*, and 2*d*) are driven to rotate by the photosensitive drums 1 (1*a*, 1*b*, 1*c*, and 1*d*). For example, the charging rollers 2 (2*a*, 2*b*, 2*c*, and 2*d*) have a diameter of 14 mm and a longitudinal length of 320 mm. For example, a charging bias (direct-current (DC) voltage: −900 V, alternating-current (AC) peak-to peak voltage: 1500 V) is applied to the charging rollers 2 (2*a*, 2*b*, 2*c*, and 2*d*) from a high voltage power supply serving as an application unit. The photosensitive drums 1 (1*a*, 1*b*, 1*c*, and 1*d*) are thereby uniformly charged.

The exposure devices 3 (3*a*, 3*b*, 3*c*, and 3*d*) are laser beam scanners including semiconductor lasers for irradiating the photosensitive drums 1 (1*a*, 1*b*, 1*c*, and 1*d*) charged by the charging rollers 2 with laser light. The exposure devices 3 (3*a*, 3*b*, 3*c*, and 3*d*) form electrostatic latent images on the photosensitive drums 1 (1*a*, 1*b*, 1*c*, and 1*d*) charged by the charging rollers 2 (2*a*, 2*b*, 2*c*, and 2*d*), based on an image signal input to the image forming apparatus.

The developing devices 4 (4*a*, 4*b*, 4*c*, and 4*d*) develop the electrostatic latent images formed on the photosensitive drums 1 (1*a*, 1*b*, 1*c*, and 1*d*) by the exposure devices 3 (3*a*, 3*b*, 3*c*, and 3*d*) with developers (toner). As a result, toner adheres to exposed portions (portions irradiated with the laser light) on the photosensitive drums (1*a*, 1*b*, 1*c*, and 1*d*), whereby the electrostatic latent images are turned into visible images.

A transfer device includes the primary transfer units including the primary transfer rollers 5 (5*a*, 5*b*, 5*c*, and 5*d*) and the secondary transfer unit including the secondary transfer roller 9.

The primary transfer rollers 5 (5*a*, 5*b*, 5*c*, and 5*d*) are pressed against the surface of the intermediate transfer belt 7, which is sandwiched between the primary transfer rollers 5 (5*a*, 5*b*, 5*c*, and 5*d*) and the photosensitive drums 1 (1*a*, 1*b*, 1*c*, and 1*d*), by a predetermined pressing force. With this configuration, the primary transfer nip portions T1 (T1*a*, T1*b*, T1*c*, and T1*d*) serving as the primary transfer units are formed.

The secondary transfer roller 9 is pressed against the surface of the intermediate transfer belt 7, which is sandwiched between the secondary transfer roller 9 and the secondary transfer counter roller 8, by a predetermined pressing force. With this configuration, the secondary transfer nip portion T2 serving as the secondary transfer unit is formed.

A transfer bias is applied to the primary transfer rollers 5 (5*a*, 5*b*, 5*c*, and 5*d*), whereby the toner images formed on the photosensitive drums 1 (1*a*, 1*b*, 1*c*, and 1*d*) are transferred onto the intermediate transfer belt 7. Transfer residual toner remaining slightly on the photosensitive drums 1 (1*a*, 1*b*, 1*c*, and 1*d*) after the first transfer is scraped off and collected by the photosensitive drum cleaning blades 6 (6*a*, 6*b*, 6*c*, and 6*d*).

A recording material (sheet) P fed from the feed cassette 10 is fed to the secondary transfer unit by the registration roller. A transfer bias is applied to the secondary transfer roller 9, whereby the toner images formed on the intermediate transfer belt 7 are transferred onto the recording material P. Transfer residual toner remaining slightly on the intermediate transfer belt 7 after the second transfer is scraped off and collected by the belt cleaner 11.

The fixing device 13 fixes the toner images transferred onto the recording material P. The recording material P subjected to the fixing processing by the fixing device 13 is discharged to the discharge tray.

If a series of image forming processes by the foregoing image forming units ends, the image forming units are ready for the next image forming operation.

<Configuration of Developing Device>

Next, a configuration of a conventional function-separated developing device will be described with reference to the sectional view of FIG. 2 and the schematic diagrams of FIGS. 3 and 4. A developing container 41 includes a developing sleeve 44, a magnet roll 44*a*, and a developing blade 42. The developing sleeve 44 serves as a developer bearing member which bears a developer. The magnet roll 44*a* includes a magnet which serves as a magnetic field generation unit. The developing blade 42 serves as a developer regulation member which forms a thin layer of the developer on the surface of the developing sleeve 44. The magnet roll 44*a* is fixed and arranged inside the developing sleeve 44.

The developing sleeve 44 is made of nonmagnetic material. For example, the developing sleeve 44 has a diameter of 20 mm and a longitudinal length of 334 mm. The developing sleeve 44 rotates in the direction of the arrow illustrated in FIG. 2 at a process speed. (circumferential speed) of 425 mm/sec.

The magnet roll 44*a* having a plurality of magnetic poles is fixedly arranged inside the developing sleeve 44 along the circumferential direction of the developing sleeve 44. A width over which the developing sleeve 44 bears the developer (hereinbelow, referred to as a developer bearing area)

in an axial direction of a rotating shaft 75 (hereinbelow, referred to as a longitudinal direction of the developing sleeve 44) of the developing sleeve 44 is substantially the same as a longitudinal width of the magnet roll 44*a*. The developer bearing area of the developing sleeve 44 refers to a maximum image area. The magnet roll 44*a* includes a developing pole S1 arranged at a position opposed to a photosensitive drum 1. The magnet roll 44*a* includes the developing pole S1, a conveyance pole N2, a stripping pole S3, a pumping pole S2, and a regulation pole N1 which are arranged in this order in the direction of rotation of the developing sleeve 44.

Figure 2:
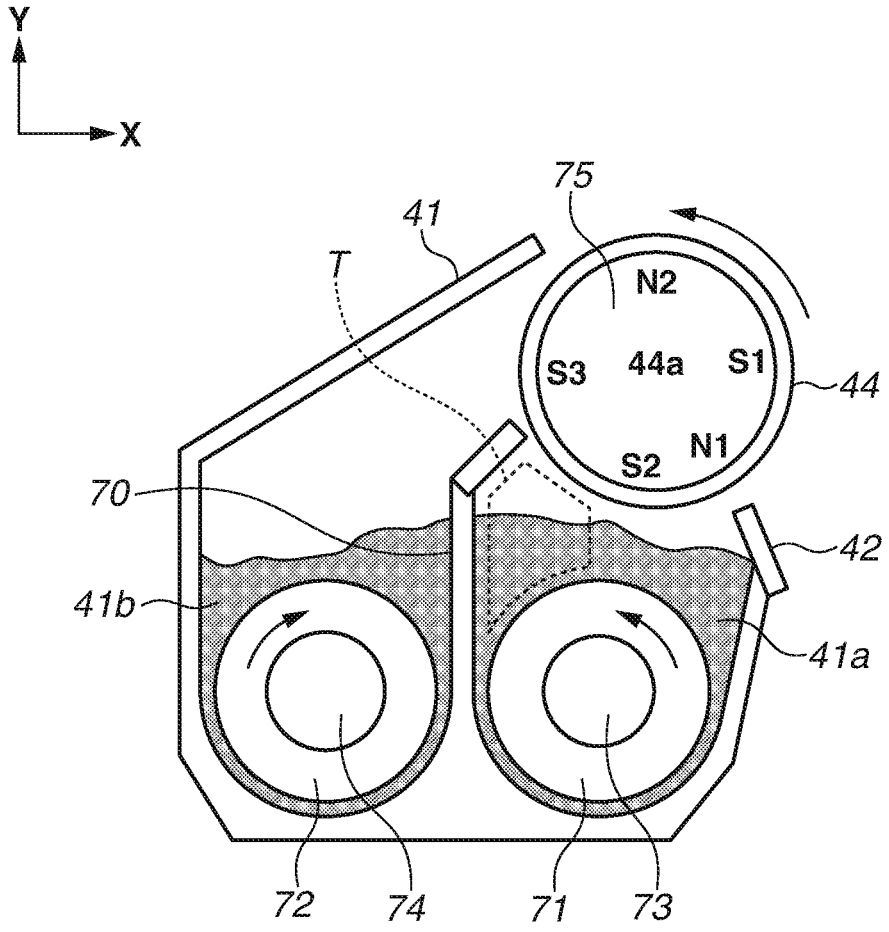
FIG. 2 is a sectional view illustrating a configuration of a conventional function-separated developing device.

As illustrated in FIG. 2, the developing container 41 includes a developing chamber 41*a* and an agitation chamber 41*b*. The developing chamber 41*a* and the agitation chamber 41*b* both can store the developer. The developer delivered from the agitation chamber 41*b* is supplied to the developing sleeve 44 in the developing chamber 41*a*. The developer separated from the developing sleeve 44 is collected in the agitation chamber 41*b*, and the collected developer is delivered from the agitation chamber 41*b* to the developing chamber 41*a*. Since the agitation chamber 41*b* plays the role of collecting the separated developer as well, the agitation chamber 41*b* is also referred to as a collection chamber.

In the longitudinal direction of the developing sleeve 44, the developing chamber 41*a* has an opening formed at a position corresponding to an area (hereinbelow, referred to as a developing area) of the developing sleeve 44 opposed to the photosensitive drum 1. The developing sleeve 44 is rotatably arranged in the opening so that part of the developing sleeve 44 is exposed.

The developing container 41 includes a first conveyance screw 71 serving as a first conveyance member and a second conveyance screw 72 serving as a second conveyance member. The first conveyance screw 71 agitates and conveys the developer in the developing chamber 41*a*. The second conveyance screw 72 agitates and conveys the developer already existing in the agitation chamber 41*b* with toner that is supplied by a developer replenishment mechanism (hopper) intended for replenishment of the developer.

Figure 3:
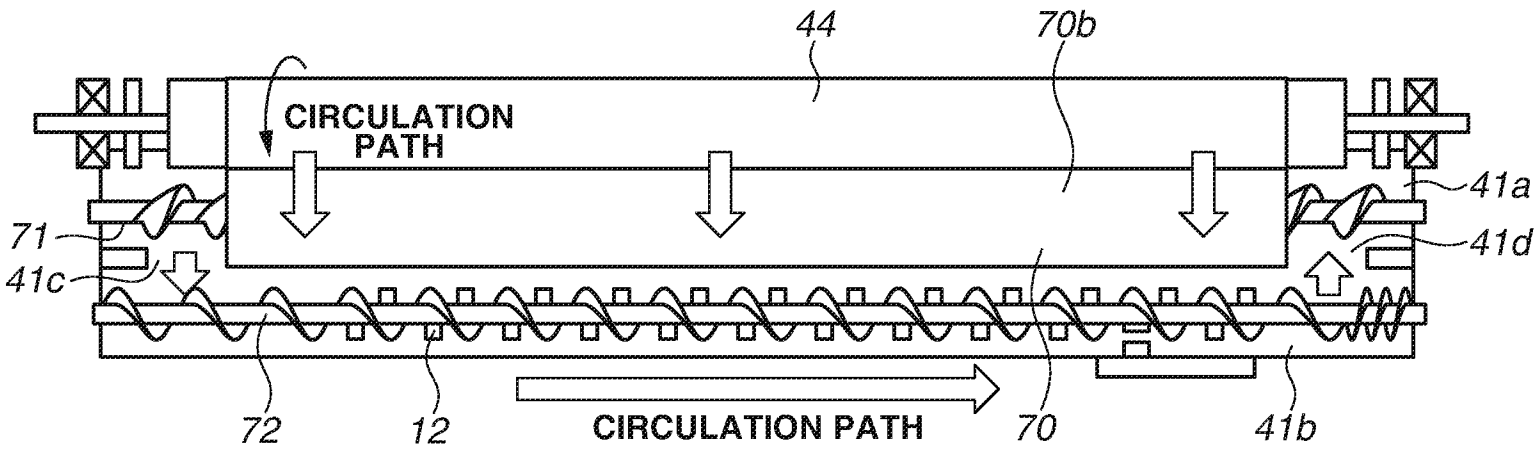
FIG. 3 is a schematic diagram illustrating the configuration of the conventional function-separated developing device.
Figure 4:
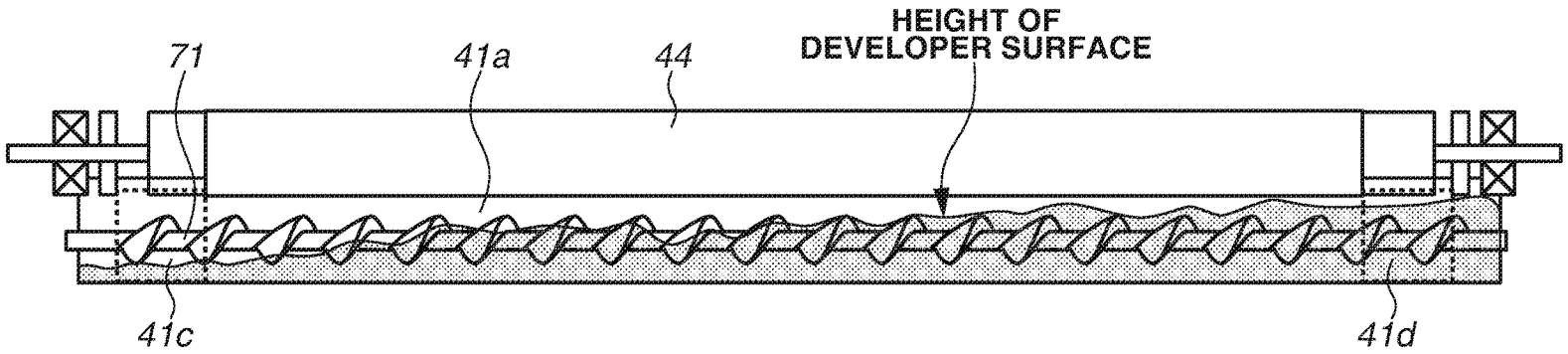
FIG. 4 is a schematic diagram illustrating the configuration of the conventional function-separated developing device.

As illustrated in FIG. 3, the first conveyance screw 71 includes a rotating shaft 73 made of a shaft of magnetic material. A spiral blade serving as a conveyance unit is formed around the rotating shaft 73. The first conveyance screw 71 is arranged along the longitudinal direction of and substantially in parallel with the developing sleeve 44. Similarly, the second conveyance screw 72 includes a rotating shaft 74 made of magnetic material. A spiral blade serving as a conveyance unit is formed around the rotating shaft 74. The second conveyance screw 72 is arranged along the longitudinal direction and substantially in parallel with the developing sleeve 44.

Agitation ribs 12 having a predetermined width in the conveyance direction of the developer by the second conveyance screw 72 are formed on the second conveyance screw 72. The agitation ribs 12 are formed to protrude from the rotating shaft 74 in radial directions of the rotating shaft 74. As the rotating shaft 74 of the second conveyance screw 72 rotates, the agitation ribs 12 agitate the developer in a direction orthogonal to the conveyance direction of the developer by the second conveyance screw 72.

The developer in the developing chamber 41*a* is supplied to the developing sleeve 44 by the first conveyance screw 71. If the developer is supplied to the developing sleeve 44, a predetermined amount of developer is borne on the developing sleeve 44 by a magnetic field generated by the magnet roll 44*a*. At that time, a developer bank is formed on the developing sleeve 44. As the developing sleeve 44 rotates, the developer borne on the developing sleeve 44 passes the developer bank and is regulated in thickness by the developing blade 42. The developer borne on the developing sleeve 44 is then conveyed to the developing area.

In the developing area, the developer borne on the developing sleeve 44 is napped to form a magnetic brush. The magnetic brush is brought into contact with the photosensitive drum 1 to supply toner to the photosensitive drum 1, whereby an electrostatic latent image formed on the photosensitive drum 1 is developed as a toner image. To improve the application rate (development efficiency) of the toner to the electrostatic latent image formed on the photosensitive drum 1, a developing bias voltage is applied to the developing sleeve 44 from a developing bias power supply serving as a voltage application unit. The developing bias voltage is obtained by superposing an AC voltage on a DC voltage.

As the developing sleeve 44 rotates, the developer on the developing sleeve 44 after supplying the toner to the photosensitive drum 1 is stripped off the developing sleeve 44 by a repulsive magnetic field. The repulsive magnetic field is formed by the juxtaposition of the stripping pole S3 and the pumping pole S2, which are magnetic poles of the same polarity, arranged on the magnet roll 44*a*.

As illustrated in FIG. 2, the developing container 41 includes a partition 70 for dividing the interior of the developing container 41 between the developing chamber 41*a* and the agitation chamber 41*b*. The partition 70 extends in the longitudinal direction of the first conveyance screw 71. The partition 70 is arranged to approach an outer periphery of the developing sleeve 44 from a lower part of the developing container 41 in the circumferential direction of the first conveyance screw 71.

As illustrated in FIG. 3, in the longitudinal direction of the partition 70, a first delivery portion 41*c* is provided in one end portion of the partition 70, and a second delivery portion 41*d* is provided in the other end portion of the partition 70. The first delivery portion 41*c* plays the role of a communication portion for communicating the developer from the developing chamber 41*a* to the agitation chamber 41*b*. In other words, the developer can be communicated from the developing chamber 41*a* to the agitation chamber 41*b* via the first delivery portion 41*c*. On the other hand, the second delivery portion 41*d* plays the role of a communication portion for communicating the developer from the agitation chamber 41*b* to the developing chamber 41*a*. In other words, the developer can be communicated from the agitation chamber 41*b* to the developing chamber 41*a* via the second delivery portion 41*d*.

The first and second conveyance screws 71 and 72 convey the developer in the developing container 41 in opposite directions along the axial direction of the rotating shaft 75 of the developing sleeve 44 (also referred to as the longitudinal direction of the developing sleeve 44). Through this operation, the first and second conveyance screws 71 and 72 circulate the developer through the developing container 41 via the first and second delivery portions 41*c* and 41*d*. In a developing step of causing the developer borne on the developing sleeve 44 to adhere to the electrostatic latent image formed on the photosensitive drum 1, the toner in the developer on the developing sleeve 44 is consumed and the toner density of the developer decreases. Such developer is stripped off the developing sleeve 44 and collected into the agitation chamber 41*b*. The developer collected into the agitation chamber 41*b* is conveyed by the second conveyance screw 72 to move through the agitation chamber 41*b*. On the other hand, the developer that is not borne on the developing sleeve 44 and left in the developing chamber 41*a* is conveyed by the first conveyance screw 71 to move through the developing chamber 41*a*. The developer is then delivered to the agitation chamber 41*b* via the first delivery portion 41*c*.

The developer stripped off the developing sleeve 44 near the stripping pole S3 of the magnet roll 44*a* falls on a slope 70*b* of the partition 70 and then collected into the agitation chamber 41*b*. The slope 70*b* is formed on an outer wall surface of the partition 70 opposing the second conveyance screw 72 in the longitudinal direction of the second conveyance screw 72. As a result, the following three types of developers exist in the agitation chamber 41: the developer delivered from the developing chamber 41*a* via the first delivery portion 41*c*; the developer of reduced toner density, stripped off the developing sleeve 44; and the developer replenished from the developer replenishment mechanism. Such kinds of developer are agitated by the second conveyance screw 72 in the agitation chamber 41*b*, and conveyed in the conveyance direction of the developer by the second conveyance screw 72. The developer agitated in the agitation chamber 41*b* move through the agitation chamber 41*b* and then is delivered to the developing chamber 41*a* via the second delivery portion 41*d*.

As illustrated in FIG. 3, there are two circulation paths from the developing chamber 41*a* to the agitation chamber 41*b*. The two circulation paths include one that circulates the developer from the developing chamber 41*a* to the agitation chamber 41*b* via the first delivery portion 41*c*, and one through which the developer stripped off the developing sleeve 44 falls on the slope 70*b* and is collected into the agitation chamber 41*b*. On the other hand, the circulation path from the agitation chamber 41*b* to the developing chamber 41*a* via the second delivery portion 41*d* is only one. As described above, in the conventional function-separated developing device, the number of paths for delivering the developer to the agitation chamber 41*b* is different from the number of paths for delivering the developer to the developing chamber 41*a*. As a result, distribution of the amount of developer in the circulation paths of the developer is not uniform.

The developer in the developing chamber 41*a* is supplied onto the developing sleeve 44 uniformly in the longitudinal direction of the developing sleeve 44 from the upstream side to the downstream side of the conveyance direction of the developer by the first conveyance screw 71 (hereinbelow, referred to as a conveyance direction of the first conveyance screw 71). As illustrated in FIG. 4, the amount of developer in the developing chamber 41*a* decreases gradually and the height of the developer surface in the developing chamber 41*a* decreases from the upstream side to the downstream side in the conveyance direction of the first conveyance screw 71.

On the other hand, the developer coming off the developing sleeve 44 falls on the slope 70*b*, and the developer collected from the developing sleeve 44 is added to the agitation chamber 41*b*. Therefore, the amount of developer in the agitation chamber 41*b* increases gradually and the height of the developer surface in the agitation chamber 41*b* increases from the upstream side to the downstream side in the conveyance direction of the developer by the second conveyance screw 72.

The developer in the developing chamber 41*a* is subjected to the magnetic force of the magnet roll 44*a* fixedly arranged inside the developing sleeve 44 and the rotational force of the first conveyance screw 71. Thus, developer in the developing chamber 41*a* is tossed up in the vertical direction of the developing chamber 41*a*.

As described above, the height of the developer surface in the developing chamber 41*a* decreases on the downstream side in the conveyance direction of the first conveyance screw 71, compared to upstream side. The distance between the developing sleeve 44 and the developer surface in the developing chamber 41*a* increases on the downstream side in the conveyance direction of the first conveyance direction, compared to the upstream side. The developing sleeve 44 is arranged vertically above the developing chamber 41*a*. In other words, the developing chamber 41*a* is located below the developing sleeve 44 in the direction of gravity. Therefore, the greater the distance between the developing sleeve 44 and the developer surface in the developing chamber 41*a*, the wider the space between the developing sleeve 44 and the developer surface in the developing chamber. The wider the space, the more likely the developer tossed up in the vertical direction of the developing chamber 41*a* is to remain in the developing chamber 41*a*. The greater the amount of developer remaining in the developing chamber 41*a*, the greater the variations in the amount of developer in the conveyance direction of the developer by the first conveyance screw 71.

Figure 5:
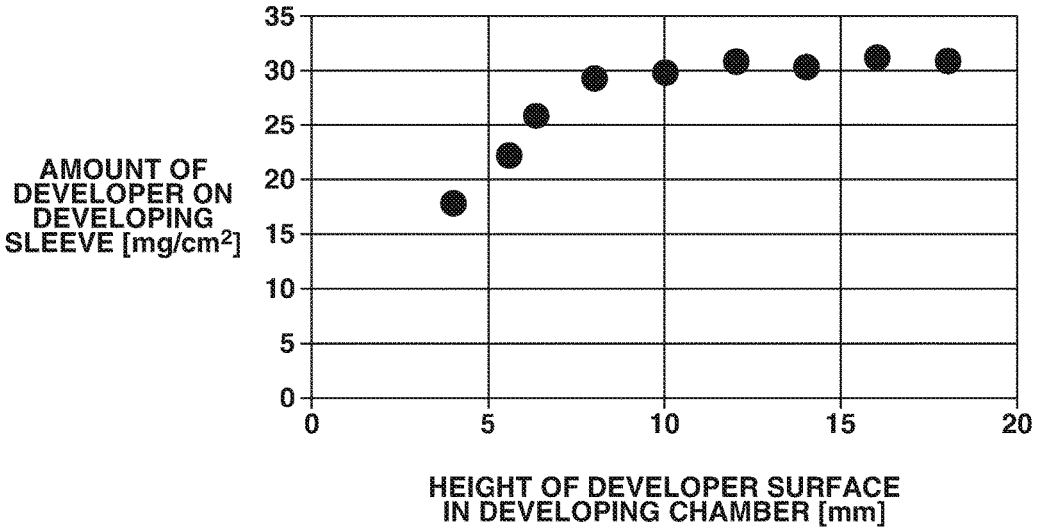
FIG. 5 is a graph illustrating a relationship between a height of a developer surface in a developing chamber and the amount of developer on a developing sleeve.
Figure 6:
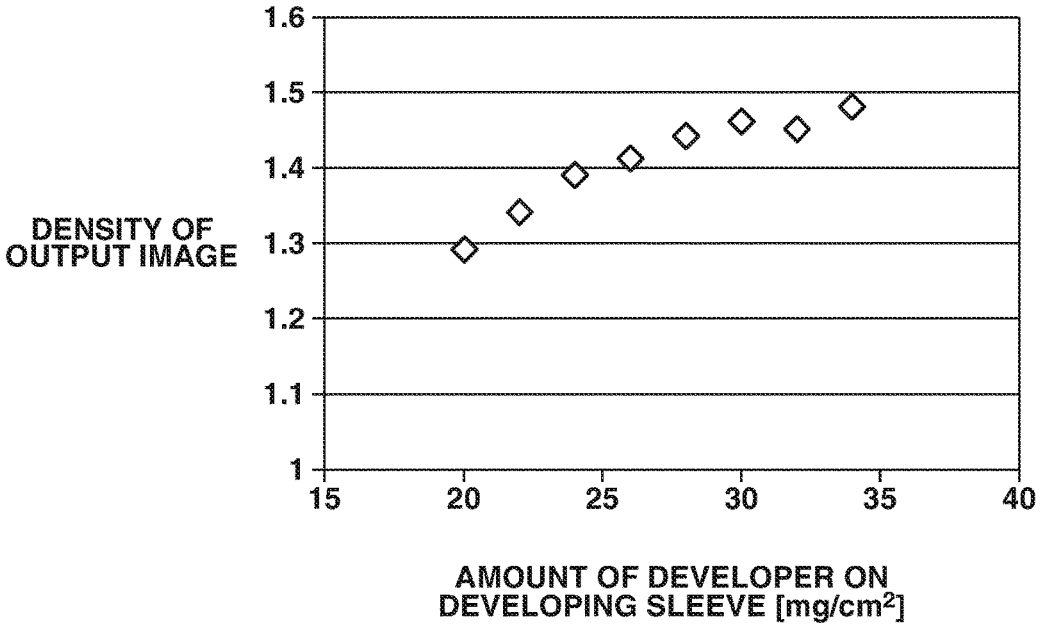
FIG. 6 is a graph illustrating a relationship between the amount of developer on the developing sleeve and an image density.

FIG. 5 illustrates a relationship between the height of the developer surface in the developing chamber 41*a* and the amount of developer borne on the developing sleeve 44. FIG. 6 illustrates a relationship between the amount of developer borne on the developing sleeve 44 and the density of an output image.

As illustrated in FIG. 5, as the height of the developer surface in the developing chamber 41*a* decreases, the amount of developer borne on the developing sleeve 44 decreases. When the amount of the developer borne on the developing sleeve 44 changes, the amount of toner in the developer used for development in the developing step changes to affect the density of the output image. As illustrated in FIG. 6, the density of the output image decreases as the amount of developer borne on the developing sleeve 44 decreases.

Therefore, function-separated developing device needs to suppress a drop in the density of the output image due to a decrease of the height of the developer surface in the developing chamber 41*a* on the downstream side in the conveyance direction of the first conveyance screw 71, compared to the upstream side.

For this reason, in the first example embodiment, the amount of developer remaining without receiving the conveyance force in the conveyance direction of the developer by the first conveyance screw 71 is reduced within the limited amount of developer without increasing the amount of developer itself loaded in the developing container 41. Specifically, the developing device 4 according to the first example embodiment is configured so that the inner wall surface of the partition 70 opposing the first conveyance screw 71 for supplying the developer to the developing sleeve 44 has an arc shape along the outer periphery of the first conveyance screw 71. This reduces variations in the amount of developer in the conveyance direction of the developer by the first conveyance screw 71. Accordingly, since the degree by which the height of the developer surface in the developing chamber 41*a* decreases on the downstream side in the conveyance direction of the first conveyance screw 71 as compared to the upstream side is suppressed, a drop in the density of the output image is suppressed. Details are described below.

First, lines of magnetic flux generated by the magnet roll 44*a* and magnetic force that the developer receives from the lines of magnetic flux will be described with reference to the schematic diagram of FIG. 7.

Figure 7:
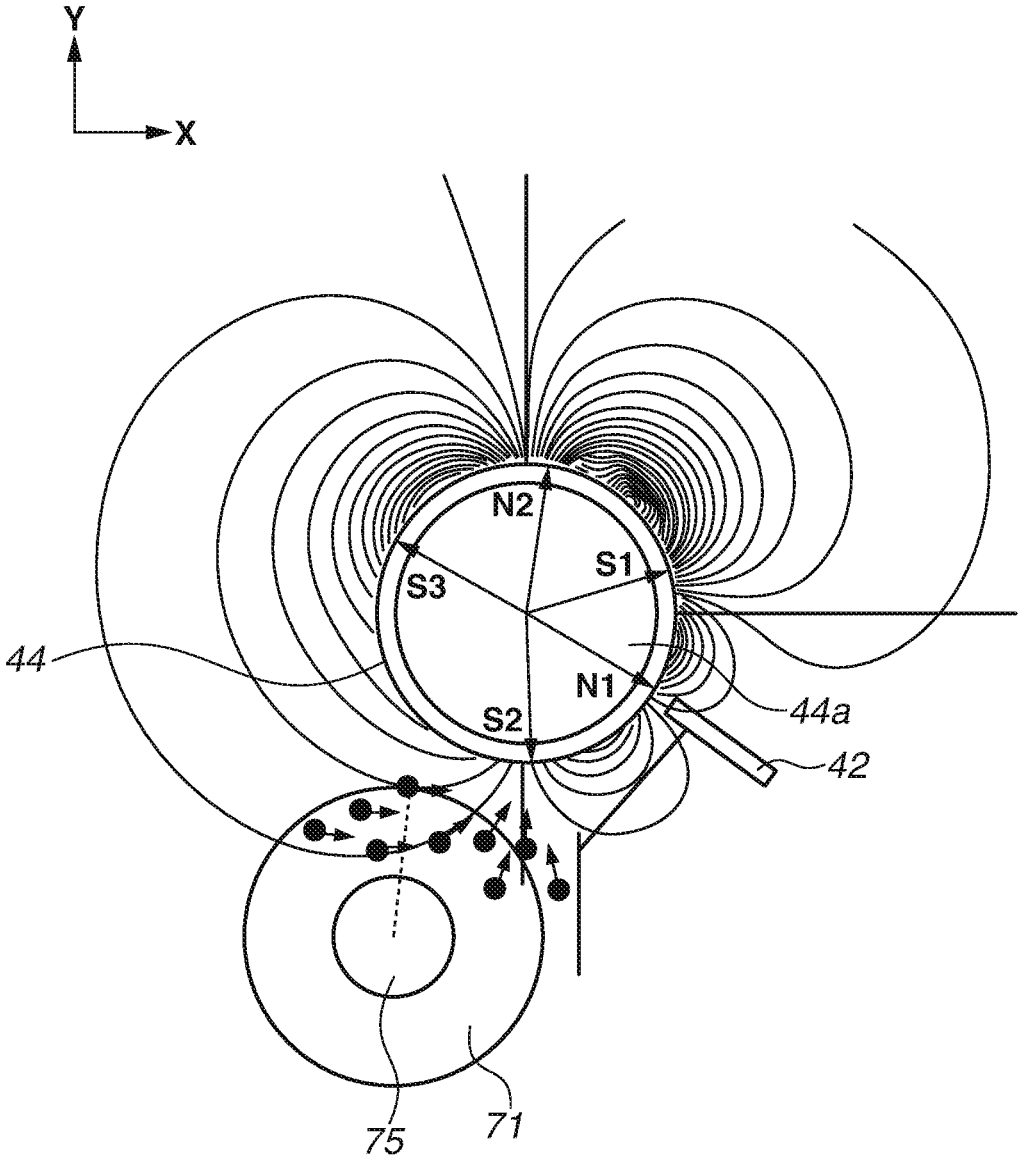
FIG. 7 is a schematic diagram illustrating magnetic force acting on the developer.

As illustrated in FIG. 7, the developer in the developing chamber 41*a* is attracted along the lines of magnetic flux. Therefore, magnetic force acting on the developer in the developing chamber 41*a* includes only components in the circumferential direction of the first conveyance screw 71 about the first conveyance screw 71, and all the lines of magnetic flux are formed to trace arcs to include the magnet roll 44*a*.

Accordingly, the developer on the upstream side of a guide surface 70*a* (see FIGS. 8 to 11) in the direction of rotation of the developing sleeve 44 receives magnetic force in a direction away from the partition 70. On the other hand, if the guide surface 70*a* is extended downstream in the direction of rotation of the developing sleeve 44, the developer receives magnetic force in a direction of being pressed against the guide surface 70*a*.

<Configuration of Inner Wall Surface of Partition>

The developing device 4 according to the first example embodiment is a function-separated developing device in which the function of collecting the developer coming off the developing sleeve 44 into the agitation chamber 41*b* is separated from the function of supplying the developer delivered from the agitation chamber 41*b* to the developing sleeve 44 in the developing chamber 41*a*. When the developing device 4 according to the present example embodiment is mounted on the image forming apparatus, the center (rotation center) of the rotating shaft 74 of the second conveyance screw 72 is positioned above or at the same height as the center (rotation center) of the rotating shaft 73 of the first conveyance screw 71 in the vertical direction of the image forming apparatus.

The developing device 4 according to the first example embodiment differs from the conventional function-separated developing device illustrated in FIG. 2 in the configuration of the inner wall surface of the partition 70. Therefore, the configuration of the partition 70 according to the first example embodiment will be described with reference to the sectional views of FIGS. 8 to 11.

Figure 8:
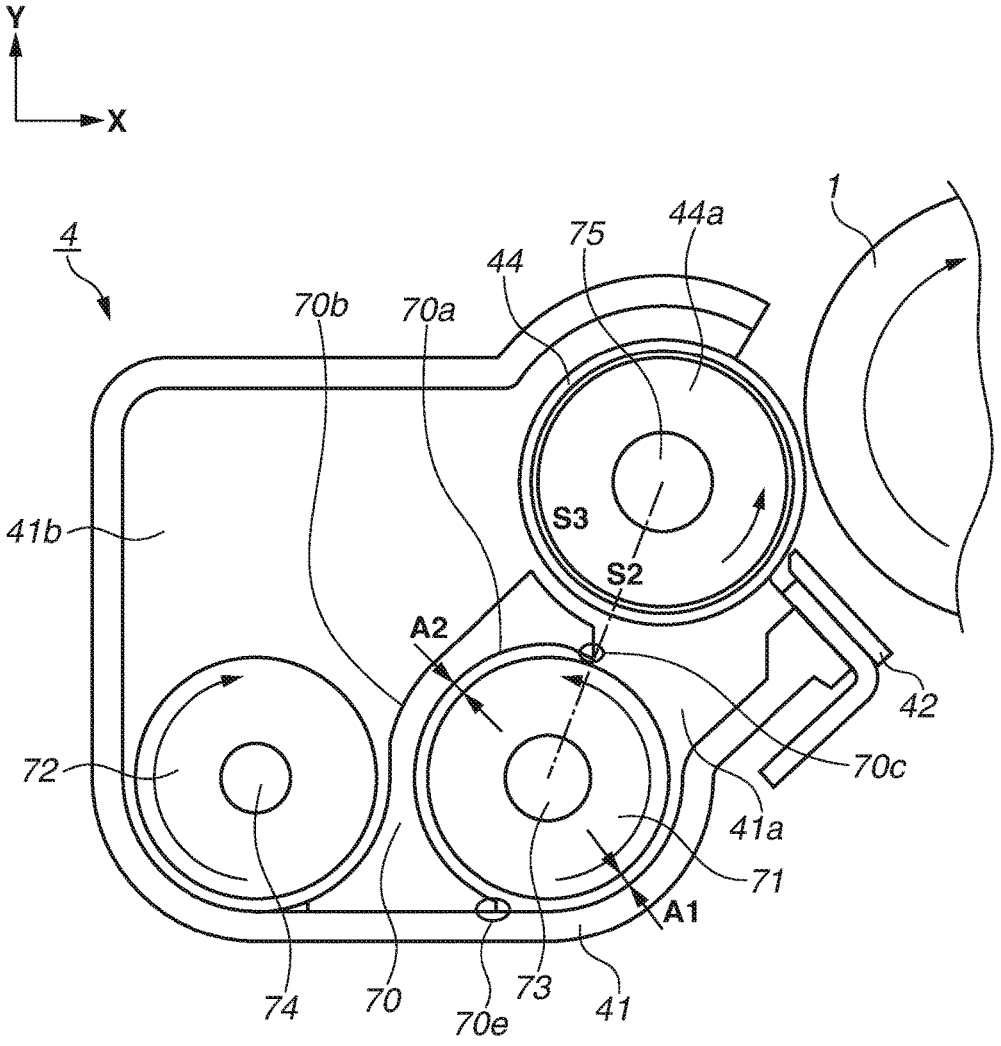
FIG. 8 is a sectional view illustrating a configuration of a developing device according to a first example embodiment.

As illustrated in FIG. 8, the developing device 4 includes a slope 70*b* for receiving the developer of which toner is consumed in the developing step and the toner density is lowered on the developing sleeve 44, and delivering the developer to the agitation chamber 41*b*. The slope 70*b* is formed on the outer wall surface of the partition 70. The outer wall surface of the partition 70 is opposed to the second conveyance screw 72 along the longitudinal direction of the second conveyance screw 72.

Further, as illustrated in FIG. 8, the developing device 4 includes the guide surface 70*a* for guiding conveyance of the developer. The guide surface 70*a* is formed in an arc shape along the outer periphery of the first conveyance screw 71 in the example of FIG. 8, the guide surface 70*a* is uniformly formed as an identical surface over the entire area in the longitudinal direction of the first conveyance screw 71. The center of the arc of the arc-shaped guide surface 70*a* is located at the same position as the rotation center of the first conveyance screw 71. The guide surface 70*a* and the first conveyance screw 71 are concentric to each other. A point where the arc-shaped guide surface 70*a* comes into contact with the bottom surface of the developing chamber 41*a* is an endpoint (start point) 70*e* of the guide surface 70*a*. In other words, the guide surface 70*a* is extended from the bottom portion of the developing chamber 41*a* opposing the first conveyance screw 71. A clearance formed between the outer periphery of the first conveyance screw 71 and the guide surface 70*a* has a constant size over the entire area in the longitudinal direction of the first conveyance screw 71.

When the first conveyance screw 71 conveys the developer, the developer is pushed out in direction perpendicular to the conveyance direction of the first conveyance screw 71 because of the rotating operation of the first conveyance screw and the shape of the first conveyance screw 71. The guide surface 70*a* lies close to the outer periphery of the first conveyance screw 71 and thus serves as a surface for receiving the developer pushed out in the direction perpendicular to the conveyance direction of the first conveyance screw 71.

As illustrated in FIG. 8, a clearance A1 is formed in the developing chamber 41*a*, between the outer periphery of the first conveyance screw 71 and the bottom surface of the developing chamber 41*a*. Further, a clearance A2 is formed in the developing chamber 41*a*, between the outer peripheral of the first conveyance screw 71 and the guide surface 70*a*.

In the example of FIG. 8, the clearances A1 and A2 have the same length (e.g., 1 mm). Since the clearances A1 and A2 have the same length, the developer pushed out in the direction perpendicular to the conveyance direction of the first conveyance screw 71 rebounds uniformly from the guide surface 70*a*. This reduces the amount of developer that is pushed out in the direction perpendicular to the conveyance direction of the first conveyance screw 71 and remains there without receiving the conveyance force in the conveyance direction of the first conveyance screw 71.

The amount of developer that is pushed out in the direction perpendicular to the conveyance direction of the first conveyance screw 71 and rebounds from the guide surface 70*a* is desirably increased. Thus, the length of the area in which the guide surface 70*a* adjoins the outer periphery of the first conveyance screw 71 is increased in the circumferential direction of the first conveyance screw 71.

In the example of FIG. 8, a point where a line connecting a local maximum peak position of the magnetic flux density of a nearest magnetic pole (pumping pole S2) and the rotation center of the first conveyance screw 71 intersects with the guide surface 70*a* is set as an endpoint 70*c* of the guide surface 70*a*. The nearest magnetic pole refers to one that is the closet to the rotating shaft 73 of the first conveyance screw 71 among the magnetic poles provided on the magnet roll 44*a* (developing pole S1, conveyance pole N2, stripping pole S3, pumping pole S2, and regulation pole N1).

Figure 9:
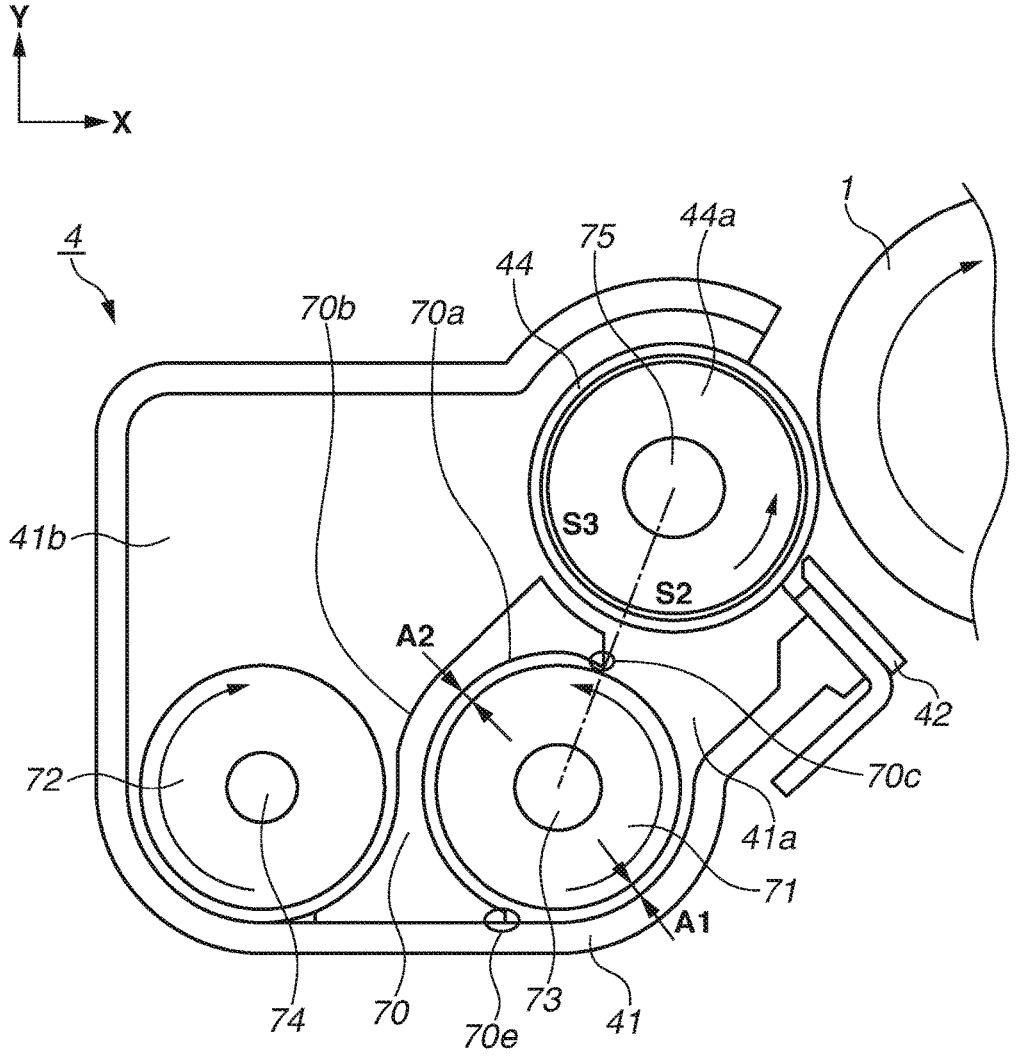
FIG. 9 is a sectional view illustrating a configuration of the developing device according to the first example embodiment.

Further, in the example of FIG. 9, like the example of FIG. 8, the center of the arc of the arc-shaped guide surface 70*a* is located in the same position as the rotation center of the first conveyance screw 71. The guide surface 70*a* and the first conveyance screw 71 are concentric to each other. Further, in the example of FIG. 9, like the example of FIG. 8, the point where the arc-shaped guide surface 70*a* comes into contact with the bottom surface of the developing chamber 41*a* is set as the endpoint 70*e* of the guide surface 70*a*. On the other hand, unlike the example of FIG. 8, in the example of FIG. 9, a point where a line connecting the rotation center of the first conveyance screw 71 and the center (rotation center) of the rotating shaft 75 of the magnet roll 44*a* intersects with the guide surface 70*a* is set as the endpoint 70*c* of the guide surface 70*a*. In the example of FIG. 9, the line connecting the rotation center of the first conveyance screw 71 and the endpoint 70*c* of the guide surface 70*a* intersects with an interval from a local maximum peak position of the magnetic flux density of the stripping pole S3 to the local maximum peak position of the magnetic flux density of the pumping pole S2 on the surface of the developing sleeve 44. With this configuration, the developer can be supplied to the developing sleeve 44 on the upstream side of the pumping pole S2 in the direction of rotation of the developing sleeve 44 to further improve the supply capability of the developer.

Figure 10:
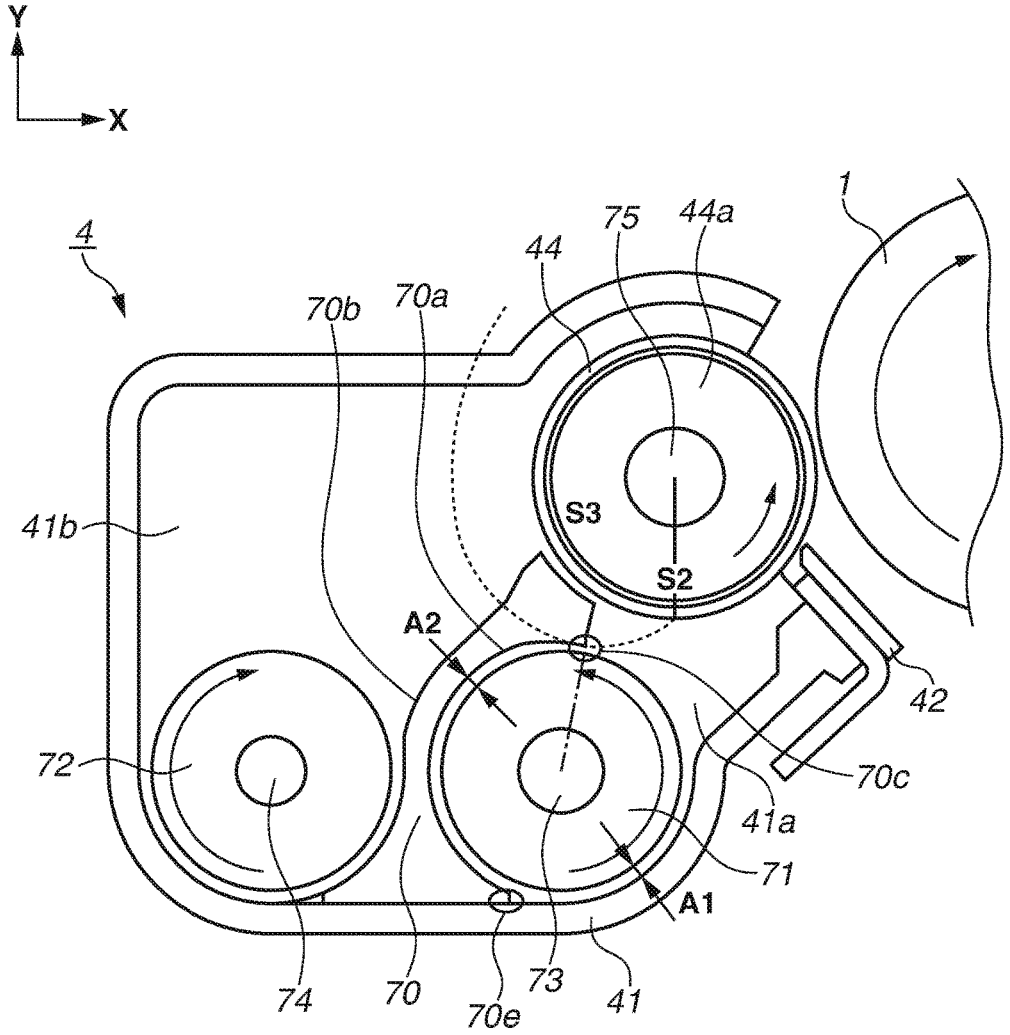
FIG. 10 is a sectional view illustrating a configuration of the developing device according to the first example embodiment.

In the example of FIG. 10, like the example of FIG. 8, the center of the arc of the arc-shaped guide surface 70*a* is located at the same position as the rotation center of the rotating shaft 73 of the first conveyance screw 71. The guide surface 70*a* and the first conveyance screw 71 are concentric to each other. In the example of FIG. 10, like the example of FIG. 8, the point where the arc-shaped guide surface 70*a* comes into contact with the bottom surface of the developing chamber 41*a* is set as the endpoint 70*e* of the guide surface 70*a*. On the other hand, unlike the example of FIG. 8, in the example of FIG. 10, a point where a normal direction component of the magnetic field generated by the magnet roll 44*a* about the rotating shaft 73 of the first conveyance screw 71 becomes zero is set as the endpoint 70*c* of the guide surface 70*a*. In the example of FIG. 10, the line connecting the rotation center of the first conveyance screw 71 and the endpoint 70*c* of the guide surface 70*a* intersects with the interval from the local maximum peak position of the magnetic flux density of the stripping pole S3 to that of the magnetic flux density of the pumping pole S2 on the surface of the developing sleeve 44.

To efficiently supply the developer to the developing sleeve 44 without interference, as illustrated in FIGS. 8 to 10, it is required that the partition 70 does not exist in the traveling direction of the developer attracted by the magnetic field generated by the magnet roll 44*a*. In other words, it is only necessary to consider the magnetic force that the developer receives at an arbitrary point on the guide surface 70*a*. In any of the examples of FIGS. 8 to 10, when seen in a cross section orthogonal to the rotation axis of the first conveyance screw 71, the guide surface 70*a* is arranged so that the endpoint 70*c* of the guide surface 70*a* lies below in the direction of gravity and overlaps with the interval from the local maximum peak position of the magnetic flux density of the stripping pole S3 to that of the magnetic flux density of the pumping pole S2 on the surface of the developing sleeve 44.

Figure 11:
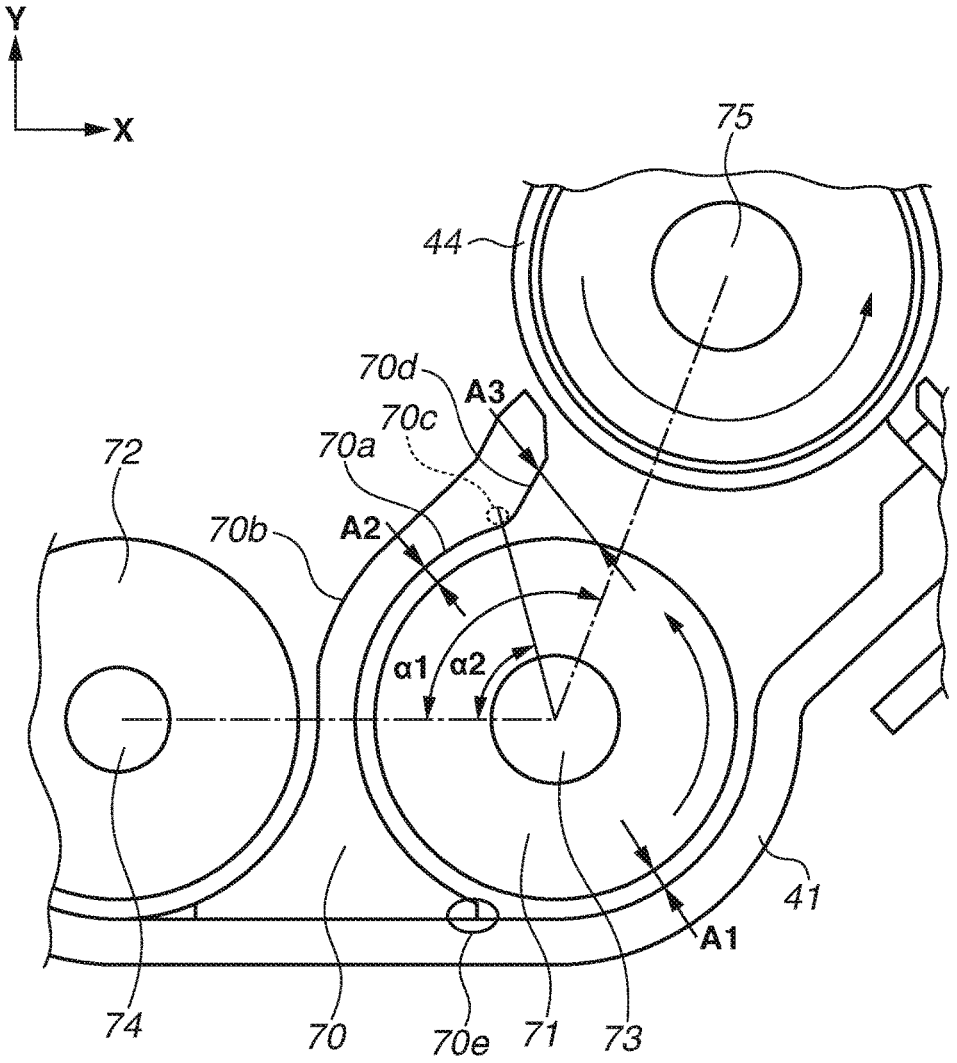
FIG. 11 is a sectional view illustrating a configuration of the developing device according to the first example embodiment.

In the example of FIG. 11, like the example of FIG. 8, the center of the arc of the arc-shaped guide surface 70*a* is located at the same position as the rotation center of the first conveyance screw 71. The guide surface 70*a* and the first conveyance screw 71 are concentric to each other. Further, in the example of FIG. 11, like the example of FIG. 8, the point where the arc-shaped guide surface 70*a* comes into contact with the bottom surface of the developing chamber 41*a* is set as the endpoint 70*e* of the guide surface 70*a*.

As illustrated in FIG. 11, an angle formed between a line connecting the rotation center of the first conveyance screw 71 with that of the second conveyance screw 72 and a line connecting the rotation center of the first conveyance screw 71 with the center of the rotating shaft 75 of the developing sleeve 44 will be referred to as an angle $\alpha 1$. As illustrated in FIG. 11, an angle formed between the line connecting the rotation center of the first conveyance screw 71 with that of the second conveyance screw 72 and the line connecting the rotation center of the first conveyance screw 71 with the endpoint 70*c* of the guide surface 70*a* will be referred to as an angle $\alpha 2$.

The position of the endpoint 70*c* of the guide surface 70*a* is such that the angle $\alpha 2$ is at least 30% of the angle $\alpha 1$, and the clearance A2 is within the range of 50% to 150% of the clearance A1 in size. By satisfying such a condition, the effect of reducing variations of the developer in the conveyance direction of the developer by the first conveyance screw 71 can be obtained.

On the other hand, if the endpoint 70*c* of the guide surface 70*a* is extended to the downstream side of the nearest magnetic pole in the direction of rotation of the developing sleeve 44, the developer pumped up by the pumping pole S2 collides with (rebounds from) the guide surface 70*a* to hinder the supply of the developer to the developing sleeve 44.

To solve this problem, as illustrated in FIG. 11, a tapered surface 70*d* is formed on the end portion of the guide surface 70*a*. A clearance A3 formed between the outer periphery of the first conveyance screw 71 and the tapered surface 70*d* increases gradually in size as approaching the developing sleeve 44, starting at the endpoint 70*c* of the guide surface 70*a*. In other words, the clearance A3 is greater than the clearance A2 in size. With this configuration, the developer pumped up by the pumping pole S2 becomes less likely to collide with the tapered surface 70*d*, so that the developing sleeve 44 can take in the developer pumped up by the pumping pole S2 more easily. As a result, it becomes possible to prevent hindrance to the supply of the developer to the developing sleeve 44.

Next, a transition of the amount of developer borne on the developer bearing area of the developing sleeve 44 will be described with reference to FIG. 12.

Figure 12:
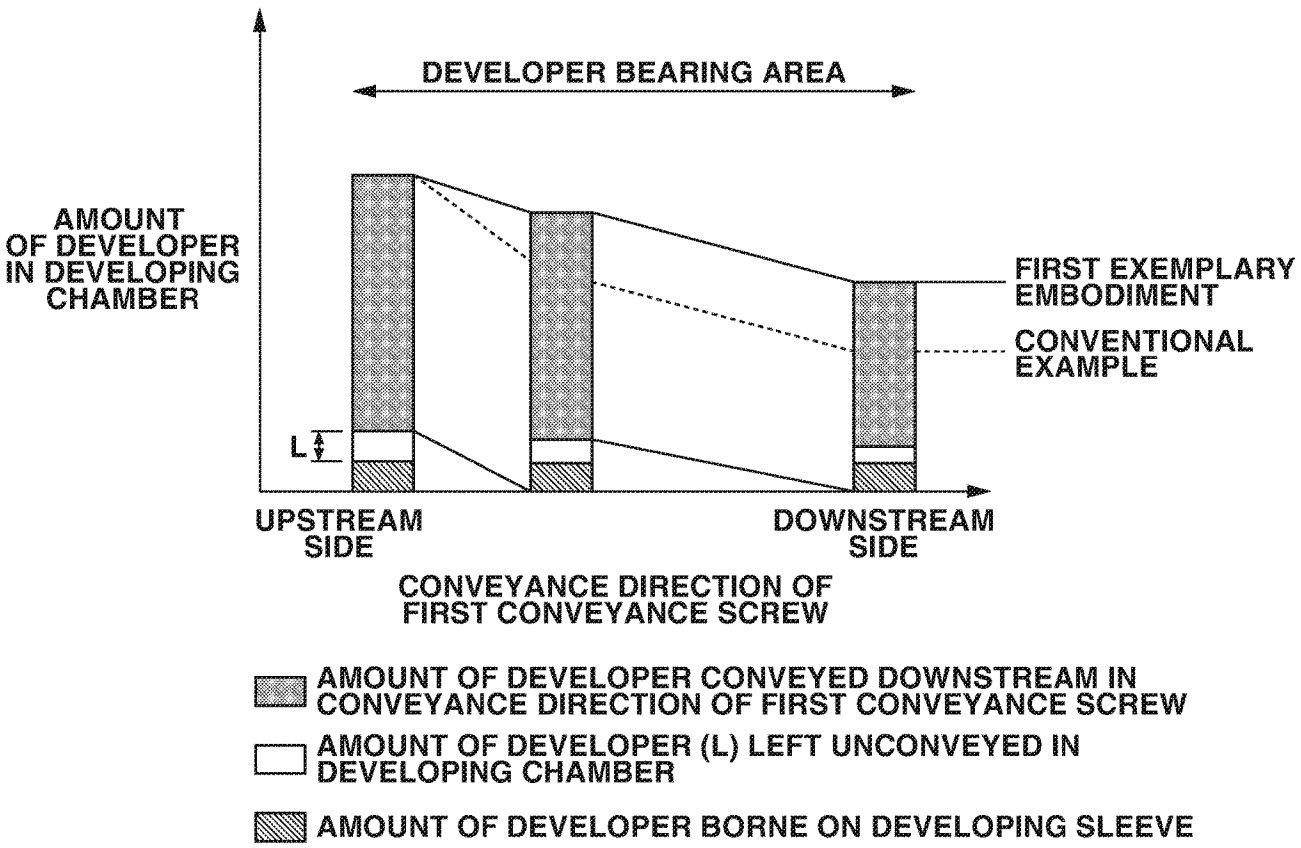
FIG. 12 is a graph illustrating a transition of the amount of developer in a developer bearing area.

As illustrated in FIG. 12, the amount of developer in the developing chamber 41*a* is divided into the amount of developer conveyed downstream in the conveyance direction of the first conveyance screw 71, the amount of developer borne on the developing sleeve 44, and the amount of developer left unconveyed in the developing chamber 41*a*. The amount of developer left unconveyed in the developing chamber 41*a* refers to the amount of developer that is left unconveyed in the developing chamber 41*a* without receiving the conveyance force in the conveyance direction of the developer by the first conveyance screw 71. If the amount of developer (L) left unconveyed in the developing chamber 41*a* is large, variations in the amount of developer conveyed downstream in the conveyance direction of the first conveyance screw 71 increase.

The developer is successively supplied to the developing sleeve 44 from the upstream side to the downstream side in the conveyance direction of the first conveyance screw 71. As a result, as illustrated by the dotted lines in FIG. 12, the amount of developer in the developing chamber 41*a* decreases on the downstream side in the conveyance direction, compared to the upstream side.

As illustrated in FIG. 2, in the conventional function-separated developing device, the space (space T in FIG. 2) formed between the partition 70 and the outer periphery of the first conveyance screw 71 is wide. Therefore, the amount of developer left unconveyed in the developing chamber 41*a* is large. As a result, as illustrated in FIG. 2, in the conventional function-separated developing device, the amount of developer for developing an electrostatic latent image formed on the photosensitive drum 1 tends to be insufficient on the downstream side in the conveyance direction of the first conveyance screw 71.

On the other hand, in the developing device according to the first example embodiment, the inner wall surface of the partition 70 opposing the first conveyance screw 71 is formed in an arc shape along the outer periphery of the first conveyance screw 71 as described above. This reduces the amount of developer left unconveyed in the developing chamber 41*a*. In this reason, in the developing device 4 according to the first example embodiment, as illustrated by the solid lines in FIG. 12, a sufficient amount of developer for developing an electrostatic latent image formed on the photosensitive drum 1 can be secured even on the downstream side in the conveyance direction of the first conveyance screw 71.

Figure 13:
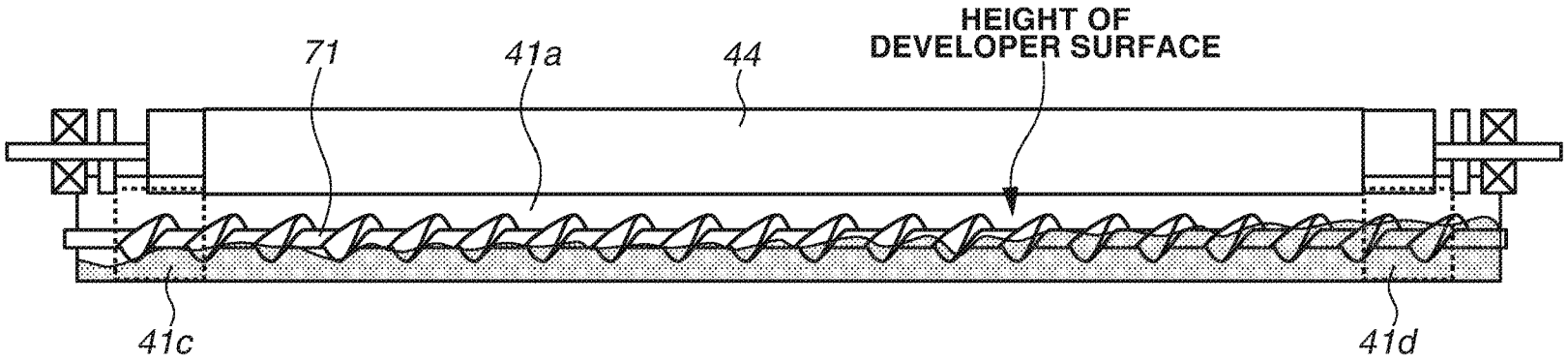
FIG. 13 is a schematic diagram illustrating a configuration of the developing device according to the first example embodiment.

Next, the height of the developer surface in the developing chamber 41*a* of the developing device 4 according to the first example embodiment will be described with reference to the schematic diagram of FIG. 13. The height of the developer surface in the developing chamber 41*a* of the conventional function-separated developing device illustrated in FIG. 2 is as illustrated in the schematic diagram of FIG. 3.

In the conventional function-separated developing device illustrated in FIG. 2, the height of the developer surface at the position of the second delivery portion 41*d* is, for example, 22 mm from the bottom surface of the developing chamber 41*a*. In such a developing device, the height of the developer surface at the position of the first delivery portion 41*c* is, for example, 6 mm from the bottom surface of the developing chamber 41*a*, slightly below the rotation center of the first conveyance screw 71.

The amount of developer borne on the developing sleeve 44 in an area where the developer surface in the developing chamber 41*a* has a sufficient height (16 mm) and that in an area where the developer surface in the developing chamber 41*a* has a height of 6 mm will be compared with reference to FIG. 5. When the developer surface in the developing chamber 41*a* has a height of 16 mm, the amount of developer borne on the developing sleeve 44 is 30 mg/cm$^2$. On the other hand, when the developer surface in the developing chamber 41*a* has a height of 6 mm, the amount of developer borne on the developing sleeve 44 is 22 mg/cm$^2$. Thus, if the amount of developer borne on the developing sleeve 44 is 22 mg/cm$^2$ when an image is formed, the output image decreases in density.

On the other hand, in the developing device according to the first example embodiment, the height of the developer surface at the position of the second delivery portion 41*d* is 20 mm, and the height of the developer surface in the first delivery portion 41*c* is 11 mm. As can be seen in FIG. 5, the developing device 4 according to the first example embodiment can maintain the amount of developer borne on the developing sleeve 44 at or above 27 mg/cm$^2$. Therefore, since the developing device 4 according to the first example embodiment can supply a sufficient amount of toner to the photosensitive drum 1, the output image will not decrease in density.

Consequently, in the developing device 4 according to the first example embodiment, since the amount of developer borne on the surface of the developing sleeve 44 will not be uneven throughout the longitudinal direction of the developing sleeve 44, variations will not occur in the density of the output image. In other words, in the developing device 4 according to the first example embodiment, variations in the amount of conveyance of the developer are reduced. Therefore, the amount of developer itself loaded into the developing container 41 does not need to be increased in consideration of variations in the amount of conveyance of the developer. In the developing device 4 according to the first example embodiment, the amount of developer initially loaded into the developing container 41 can be reduced, for example, from 280 g to 250 g.

As described above, according to the first example embodiment, the inner wall surface of the partition 70 opposing the first conveyance screw 71 for supplying the developer to the developing sleeve 44 is formed in an arc shape along the outer periphery of the first conveyance screw 71. In addition, the position of the endpoint 70*c* of the guide surface 70*a* is such that the angle $\alpha 2$ is at least 30% of the angle $\alpha 1$ and the clearance A2 is within the range of 50% to 150% of the clearance A1 in size. This can reduce the amount of developer remaining without receiving the conveyance force in the conveyance direction of the developer by the first conveyance screw 71. Therefore, variations in the amount of developer in the conveyance direction of the developer by the first conveyance screw 71 can be reduced. Thus, since the degree by which the height of the developer surface in the developing chamber 41*a* decreases an the downstream side in the conveyance direction of the first conveyance screw 71 as compared to the upstream side is suppressed, a decrease in the density of the output image can be suppressed.

In the foregoing first example embodiment, the guide surface 70*a* having an arc shape along the outer periphery of the first conveyance screw 71 is formed on the inner wall surface of the partition 70 over the enter area in the longitudinal direction of the first conveyance screw 71.

A second example embodiment differs from the first example embodiment in the configuration of the inner wall surface of the partition 70. Thus, the configuration of the inner wall surface of the partition 70 according to the second example embodiment will be described with reference to the perspective view of FIG. 14. In the second example embodiment, members similar to those of the first example embodiment will be designated by the same reference numerals. A description of members having configurations or functions similar to those in the first example embodiment will be omitted.

Figure 14:
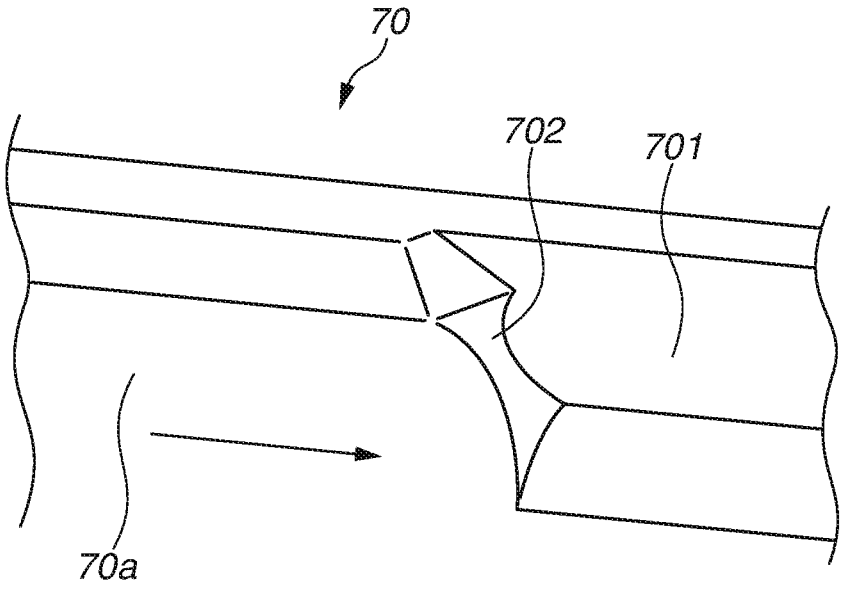
FIG. 14 is a perspective view illustrating a configuration of a developing device according to a second example embodiment.

FIG. 14 is a perspective view of the partition 70 as seen in the conveyance direction of the first conveyance screw 71. In the second example embodiment, the guide surface 70*a* is formed on the inner wall surface of the partition 70 within a range of 20% of the developer bearing area (maximum image area) from the most upstream position in the conveyance direction of the first conveyance screw 71 (direction of arrow in FIG. 14).

Further, as illustrated in FIG. 14, there are a tapered surface 702 and a non-guide surface 701 on the downstream side of the guide surface 70*a* in the conveyance direction of the first conveyance screw 71. More specifically, the tapered surface 702 in which the clearance A2 formed between the outer periphery of the first conveyance screw 71 and the inner wall surface of the partition 70 increases gradually in size toward the downstream side in the conveyance direction of the first conveyance screw 71 adjoins the non-guide surface 701.

As described above in FIG. 12, the amount of developer conveyed in the conveyance chamber 41*a* is large on the upstream side in the conveyance direction of the first conveyance screw 71, compared to the downstream side. Therefore, the effect of the guide surface 70*a* to reduce variations in the amount of developer in the conveyance direction of the first conveyance screw 71 is high on the upstream side in the conveyance direction of the first conveyance screw 71.

On the other hand, in the second example embodiment, the guide surface 70*a* is formed on the inner wall surface of the partition 70 within the range of 20% of the developer bearing area from the most upstream position in the conveyance direction of the first conveyance screw 71 (direction of the arrow in FIG. 14). Therefore, variations in the amount of developer in the conveyance direction of the first conveyance screw 71 can be reduced even if the inner wall surface of the partition 70 includes the non-guide surface 701 on the downstream side in the conveyance direction of the first conveyance screw 71.

A third example embodiment differs from the first and second example embodiments in the configuration of the inner wall surface of the partition 70. Thus, the configuration of the inner wall surface of the partition 70 according to the third example embodiment will be described with reference to the sectional view of FIG. 15. In the third example embodiment, members similar to those of the first and second example embodiments will be designated by the same reference numerals. A description of members having configurations or functions similar to those in the first and second example embodiments will be omitted.

Figure 15:
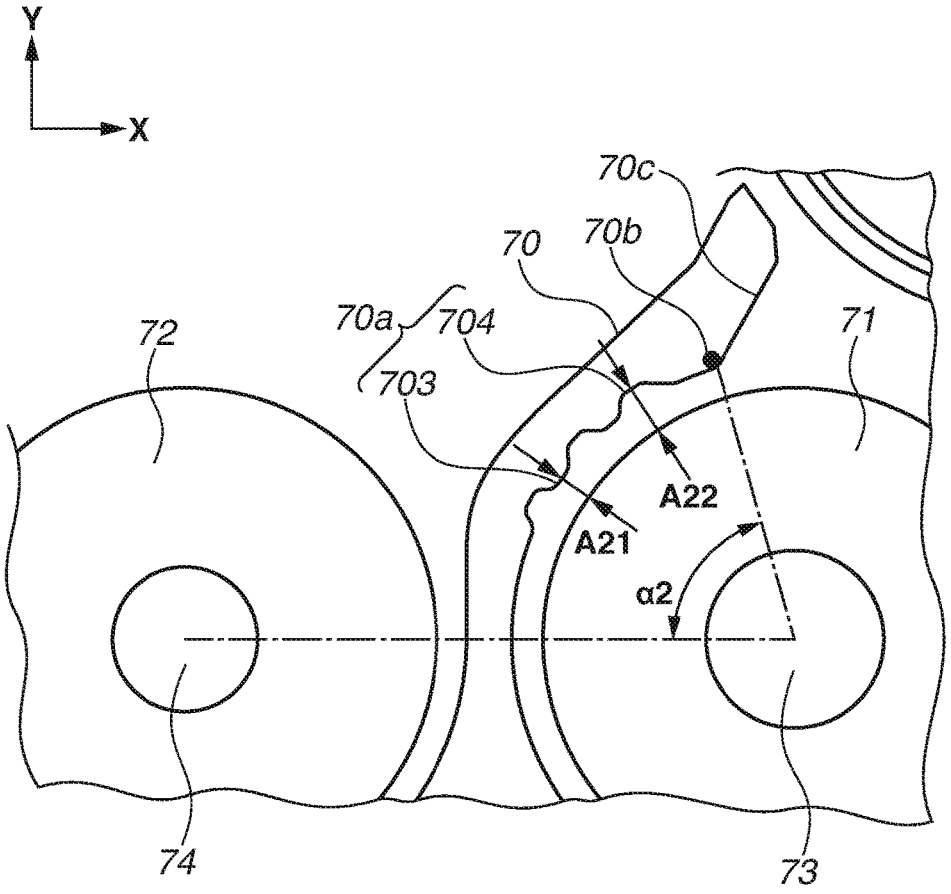
FIG. 15 is a sectional view illustrating a configuration of a developing device according to a third example embodiment.

FIG. 15 is a sectional view illustrating a configuration of the guide surface 70*a* of the developing device 4 according to the third example embodiment.

As illustrated in FIG. 15, the guide surface 70*a* has a corrugated shape including protruded surfaces 703 and recessed surfaces 704 in the circumferential direction of the first conveyance screw 71. The corrugated shape extends a direction substantially parallel to the longitudinal direction of the first conveyance screw 71.

As illustrated in FIG. 15, the protruded surfaces 703 form a clearance A21 between the outer periphery of the first conveyance screw 71 and the partition 70. The recessed surfaces 704 form a clearance A22 between the outer periphery of the first conveyance screw 71 and the partition 70. The clearance A22 has a size greater than that of the clearance A21. The clearances A21 and A22 each are within the range of 50% to 150% of the clearance A1 between the outer periphery of the first conveyance screw 71 and the bottom surface of the developing container 41 in size. Thus, the guide surface 70*a* having a corrugated shape also provides the effect of reducing variations in the amount of developer in the conveyance direction of the first conveyance screw 71.

On the other hand, if the clearance A22 is greater than 150% of the clearance A1 in size, by satisfying the following condition variations can be reduced in the amount of developer in the conveyance direction of the first conveyance screw 71. In other words, the ratio for the clearance formed between the outer periphery of the first conveyance screw 71 and the guide surface 70*a* is 50% to 150% of the clearance A1 in size in the range of the angle $\alpha 2$ is 70% or higher. The angle $\alpha 2$ refers to an angle formed between the line connecting the rotation center of the first conveyance screw 71 and the endpoint 70*c* of the guide surface 70*a* and the line connecting the rotation center of the first conveyance screw 71 and that of the second conveyance screw 72. The area sandwiched between the line connecting the rotation center of the first conveyance screw 71 and the endpoint 70*c* of the guide surface 70*a* and the line connecting the rotation center of the first conveyance screw 71 and that of the second conveyance screw 72 overlaps with the area of the guide surface 70*a*.

A fourth example embodiment differs from the first to third example embodiments in the configuration of the inner wall surface of the partition 70. Accordingly, the configuration of the inner wall surface of the partition 70 according to the fourth example embodiment will be described with reference to the sectional views of FIGS. 16 and 17.

Figure 16:
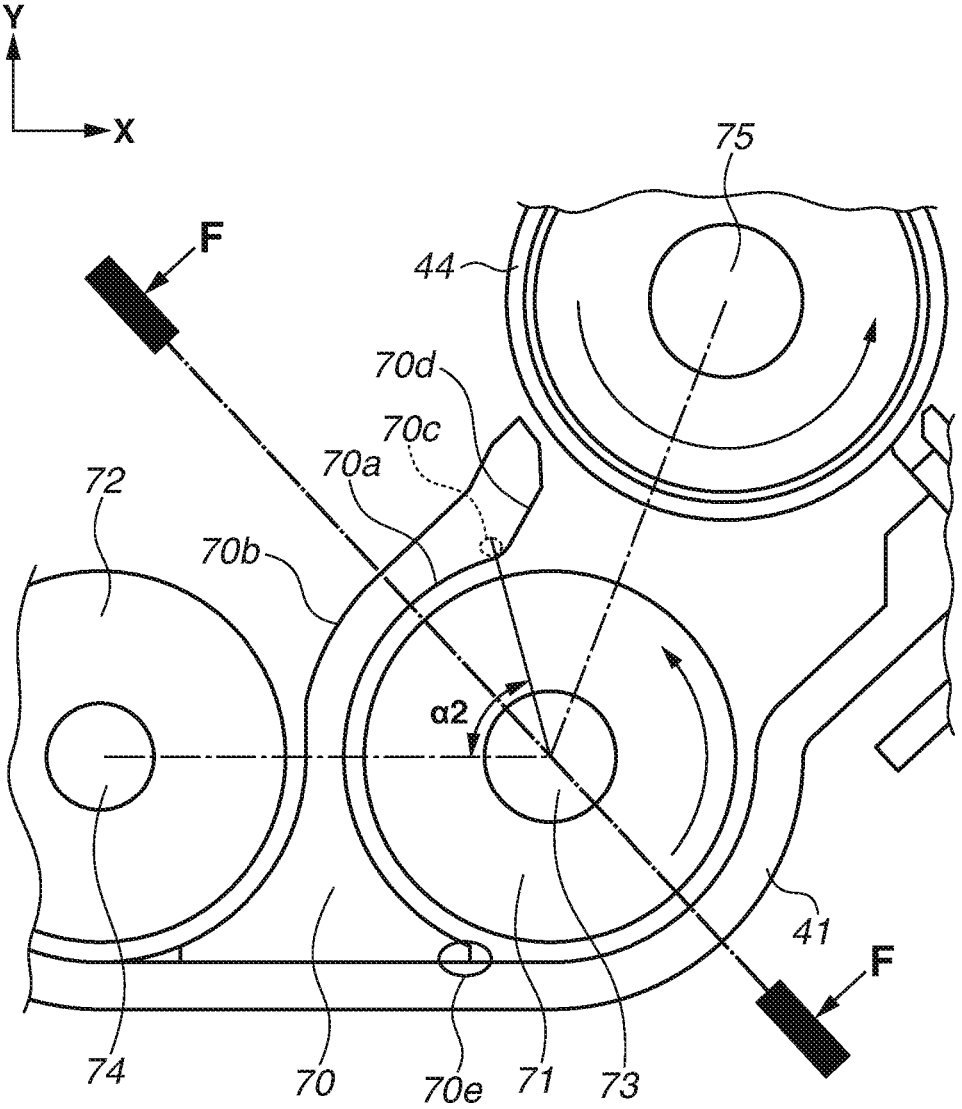
FIG. 16 is a sectional view illustrating a configuration of a developing device according to a fourth example embodiment.
Figure 17:
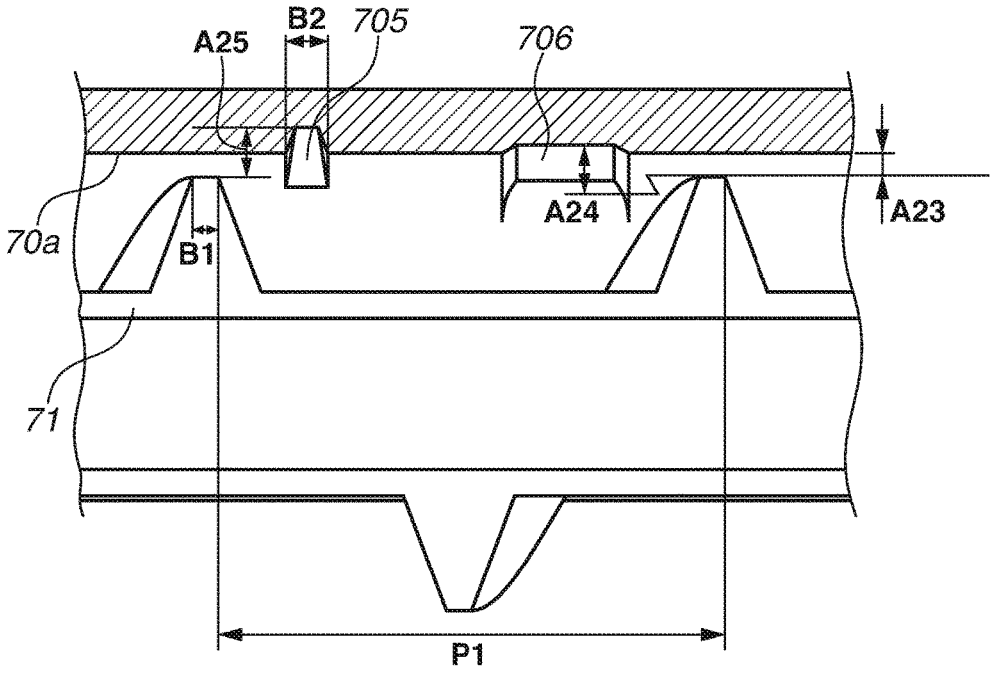
FIG. 17 is a sectional view illustrating the configuration of the developing device according to the fourth example embodiment.

FIG. 16 is a sectional view illustrating a configuration of the guide surface 70*a* according to the fourth example embodiment. FIG. 17 is a sectional view taken along a line F-F connecting the rotation center of the first conveyance screw 71 and the partition 70.

As illustrated in FIG. 17, the guide surface 70*a* includes a recessed shape 706 in the longitudinal direction of the first conveyance screw 71. A clearance A23 is formed between the outer periphery of the first conveyance screw 71 and the guide surface 70*a*. A clearance A24 is formed between the outer periphery of the first conveyance screw 71 and the recessed shape 706.

The clearances A23 and A24 each is within the range of 50% to 150% of the clearance A1 in size formed between the outer periphery of the first conveyance screw 71 and the bottom surface of the developing container 41 over the entire area in the circumferential direction of the first conveyance screw 71. Such a configuration can reduce variations in the amount of developer conveyed in the conveyance direction of the first conveyance screw 71.

As illustrated in FIG. 17, the guide surface 70*a* includes a recessed shape 705 in the longitudinal direction of the first conveyance screw 71. The recessed shape 705 is deeper than the recessed shape 706. A clearance A25 is formed between the recessed shape 705 and the outer periphery of the first conveyance screw 71. If the clearance A25 has a size outside the range of 50% to 150% of the size of the clearance A1, the following two conditions need to be satisfied to reduce variations in the amount of developer conveyed in the conveyance direction of the first conveyance screw 71.

Specifically, a first condition is that a groove width P2 of the recessed shape 705 in the longitudinal direction of the first conveyance direction 71 is within 200% of a crest width B1 of the spiral blade of the first conveyance screw 71 in size. A second condition is that the guide surface 70*a* occupies a ratio of 70% or more with respect to the recessed shape 705 within a pitch P1 between the crests of the spiral blade of the first conveyance screw 71. If the two conditions are satisfied, variations in the amount of developer conveyed in the conveyance direction of the first screw 71 can be reduced.

In such a manner, even if the guide surface 70*a* includes the recessed shapes 705 and 706 in the longitudinal direction of the first conveyance screw 71, variations in the amount of developer conveyed in the conveyance direction of the first conveyance screw 71 can be reduced.

Other Example Embodiments

The disclosure is not limited to the foregoing example embodiments. Various modifications (including organic combinations of the example embodiments) may be made based on the gist of the disclosure, and such modifications are not excluded from the scope of the disclosure.

In the foregoing example embodiments, the intermediate transfer belt 7 is described to be used as an image bearing member. However, it is not limited thereto, and an example embodiment of the disclosure may be applied to an image forming apparatus that is configured to perform transfer by sequentially bringing the photosensitive drums 1 (1*a*, 1*b*, 1*c*, and 1*d*) directly into contact with a recording medium P. In such a case, the photosensitive drums 1 (1*a*, 1*b*, 1*c*, and 1*d*) constitute rotatable image bearing members for bearing a toner image.

In the foregoing example embodiments, the developing chamber 41*a* and the agitation chamber 41*b* are described to be horizontally juxtaposed. However, it is not limited thereto. For example, an example embodiment of the disclosure may be applied to a configuration in which the developing chamber 41*a* and the agitation chamber 41*b* are vertically arranged in the direction of gravity. In such a configuration, if the developing device 4 according to the first example embodiment is mounted on the image forming apparatus, the rotation center of the first conveyance screw 71 is located above or at the same height as the rotation center of the developing sleeve 44 in the vertical direction of the image forming apparatus.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-115521, filed Jun. 9, 2016, which is hereby incorporated by reference herein in its entirety.

What is claimed is:

1. A developing device comprising:

a developer bearing member rotatably arranged and configured to bear developer including toner and carrier to convey the developer to a developing area opposing an image bearing member;

a first chamber arranged below a rotation axis of the developer bearing member and configured to supply the developer to the developer bearing member, in a state that the developing device is located at a development position at which an electrostatic latent image formed on the image bearing member is to be developed;

a second chamber opposing the developer bearing member and configured to collect the developer passing through the developing area from the developer bearing member, in a state that the developing device is located at the development position;

a first communication portion configured to permit the developer in the first chamber to be communicated from the first chamber to the second chamber;

a second communication portion configured to permit the developer in the second chamber to be communicated from the second chamber to the first chamber;

a first conveyance screw arranged in the first chamber and configured to convey the developer in the first chamber in a first direction;

a second conveyance screw arranged in the second chamber and configured to convey the developer in the second chamber in a second direction opposite to the first direction;

a magnet fixedly arranged inside the developer bearing member, including a first magnetic pole and a second magnetic pole arranged on a downstream side of a local maximum peak position of a magnetic flux density of the first magnetic pole in a rotation direction of the developer bearing member and adjacent to the first magnetic pole and having a same polarity as the first magnetic pole, and configured to generate a magnetic field for stripping the developer passing through the developing area off a surface of the developer bearing member; and a partition configured to separate the first chamber and the second chamber, the partition including a guide portion arranged opposing the developer bearing member and configured to guide the developer that has passed through the developing area from the developer bearing member to the second chamber for collection, a position at which the guide portion is closest to the developer bearing member is on a downstream side of the local maximum peak position of the magnetic flux density of the first magnetic pole and on an upstream side of a local maximum peak position of a magnetic flux density of the second magnetic pole in the rotation direction of the developer bearing member, wherein the partition extends from a bottom portion of the first chamber to at least a position opposing a second portion of an outer periphery of the first conveyance screw so that a clearance between the outer periphery of the first conveyance screw and the partition is within a range of 50% to 150% of a clearance, in size, between the outer periphery of the first conveyance screw and the bottom portion of the first chamber across an entire area of the outer periphery of the first conveyance screw on an upstream side of a first portion of the outer periphery of the first conveyance screw, the first portion opposing the bottom portion of the first chamber, and on a downstream side of the second portion of the outer periphery of the first conveyance screw, the second portion opposing the local maximum peak position of the magnetic flux density of the second magnetic pole, in the rotation direction of the developer bearing member.

2. The developing device according to claim 1, wherein the partition extends from the bottom portion of the first chamber to at least the position opposing a second portion of the outer periphery of the first conveyance screw across at least 20% of an area of the first conveyance screw corresponding to a maximum image area among image areas of the image bearing member where an image is formable on the image bearing member in the first direction.

3. The developing device according to claim 1, wherein the partition extends from the bottom portion of the first chamber to at least the position opposing a second portion of the outer periphery of the first conveyance screw across an entire area of the first conveyance screw on a downstream side of the second communication portion and on an upstream side of the first communication portion in the first direction.

4. A developing device comprising:

a developer bearing member rotatably arranged and configured to bear developer including toner and carrier to convey the developer to a developing area opposing an image bearing member;

a first chamber arranged below a rotation axis of the developer bearing member and configured to supply the developer to the developer bearing member, in a state that the developing device is located at a development position at which an electrostatic latent image formed on the image bearing member is to be developed;

a second chamber opposing the developer bearing member and configured to collect the developer passing through the developing area from the developer bearing member, in a state that the developing device is located at the development position;

a first communication portion configured to permit the developer in the first chamber to be communicated from the first chamber to the second chamber;

a second communication portion configured to permit the developer in the second chamber to be communicated from the second chamber to the first chamber;

a first conveyance screw arranged in the first chamber and configured to convey the developer in the first chamber in a first direction; and a second conveyance screw arranged in the second chamber and configured to convey the developer in the second chamber in a second direction opposite to the first direction;

a magnet fixedly arranged inside the developer bearing member, including a first magnetic pole and a second magnetic pole arranged on a downstream side of a local maximum peak position of a magnetic flux density of the first magnetic pole in a rotation direction of the developer bearing member and adjacent to the first magnetic pole and having a same polarity as the first magnetic pole, and configured to generate a magnetic field for stripping the developer passing through the developing area off a surface of the developer bearing member;

a partition configured to separate the first chamber and the second chamber, the partition including a guide portion arranged opposing the developer bearing member and configured to guide the developer that has passed through the developing area from the developer bearing member to the second chamber for collection, a position at which the guide portion is closest to the developer bearing member is on a downstream side of the local maximum peak position of the magnetic flux density of the first magnetic pole and on an upstream side of a local maximum peak position of a magnetic flux density of the second magnetic pole in the rotation direction of the developer bearing member, wherein the partition extends from a bottom portion of the first chamber to at least a position opposing a second portion of an outer periphery of the first conveyance screw so that a clearance between the outer periphery of the first conveyance screw and the partition is within a range of 50% to 150% of a clearance, in size, between the outer periphery of the first conveyance screw and the bottom portion of the first chamber across an entire area of the outer periphery of the first conveyance screw on an upstream side of a first portion of the outer periphery of the first conveyance screw, the first portion opposing the bottom portion of the first chamber, and on a downstream side of the second portion of the outer periphery of the first conveyance screw, the second portion intersecting a straight line connecting a rotation center of the developer bearing member and a rotation center of the first conveyance screw, in the rotation direction of the developer bearing member.

5. The developing device according to claim 4, wherein the partition extends from the bottom portion of the first chamber to at least the position opposing a second portion of the outer periphery of the first conveyance screw across at least 20% of an area of the first conveyance screw corresponding to a maximum image area among image areas of the image bearing member where an image is formable on the image bearing member in the first direction.

6. The developing device according to claim 4, wherein the partition extends from the bottom portion of the first chamber to at least the position opposing a second portion of the outer periphery of the first conveyance screw across an entire area of the first conveyance screw on a downstream side of the second communication portion and on an upstream side of the first communication portion in the first direction.

7. A developing device comprising:

a developer bearing member rotatably arranged and configured to bear developer including toner and carrier to convey the developer to a developing area opposing an image bearing member;

a first chamber arranged below a rotation axis of the developer bearing member and configured to supply the developer to the developer bearing member, in a state that the developing device is located at a development position at which an electrostatic latent image formed on the image bearing member is to be developed;

a second chamber opposing the developer bearing member and configured to collect the developer passing through the developing area from the developer bearing member, in a state that the developing device is located at the development position;

a first communication portion configured to permit the developer in the first chamber to be communicated from the first chamber to the second chamber;

a second communication portion configured to permit the developer in the second chamber to be communicated from the second chamber to the first chamber;

a first conveyance screw arranged in the first chamber and configured to convey the developer in the first chamber in a first direction;

a second conveyance screw arranged in the second chamber and configured to convey the developer in the second chamber in a second direction opposite to the first direction;

a magnet fixedly arranged inside the developer bearing member, including a first magnetic pole and a second magnetic pole arranged on a downstream side of a local maximum peak position of a magnetic flux density of the first magnetic pole in a rotation direction of the developer bearing member and adjacent to the first magnetic pole and having a same polarity as the first magnetic pole, and configured to generate a magnetic field for stripping the developer passing through the developing area off a surface of the developer bearing member; and a partition configured to separate the first chamber and the second chamber, the partition including a guide portion arranged opposing the developer bearing member and configured to guide the developer that has passed through the developing area from the developer bearing member to the second chamber for collection, a position at which the guide portion is closest to the developer bearing member is on a downstream side of the local maximum peak position of the magnetic flux density of the first magnetic pole and on an upstream side of a local maximum peak position of a magnetic flux density of the second magnetic pole in the rotation direction of the developer bearing member, wherein the partition extends from a bottom portion of the first chamber to at least a position opposing a second portion of an outer periphery of the first conveyance screw so that a clearance between the outer periphery of the first conveyance screw and the partition is within a range of 50% to 150% of a clearance, in size, between the outer periphery of the first conveyance screw and the bottom portion of the first chamber across an entire area of the outer periphery of the first conveyance screw on an upstream side of a first portion of the outer periphery of the first conveyance screw, the first portion opposing the bottom portion of the first chamber, and on a downstream side of the second portion of the outer periphery of the first conveyance screw, the second portion opposing a position at which a normal direction component of the magnetic density is zero on the downstream side of the local maximum peak position of the magnetic flux density of the first magnetic pole and on the upstream side of the local maximum peak position of a magnetic flux density of the second magnetic pole, in the rotation direction of the developer bearing member.

8. The developing device according to claim 7, wherein the partition extends from the bottom portion of the first chamber to at least the position opposing a second portion of the outer periphery of the first conveyance screw across at least 20% of an area of the first conveyance screw corresponding to a maximum image area among image areas of the image bearing member where an image is formable on the image bearing member in a first direction.

9. The developing device according to claim 7, wherein the partition extends from the bottom portion of the first chamber to at least the position opposing a second portion of the outer periphery of the first conveyance screw across an entire area of the first conveyance screw on a downstream side of the second communication portion and on an upstream side of the first communication portion in the first direction.

* * * * *